US007631788B2

(12) United States Patent
Litterst et al.

(10) Patent No.: US 7,631,788 B2
(45) Date of Patent: Dec. 15, 2009

(54) FLUID DISPENSING SYSTEM SUITABLE FOR DISPENSING LIQUID FLAVORINGS

(75) Inventors: Charles Litterst, Thornhill (CA); Richard Fine, Mississauga (CA)

(73) Assignee: Zavida Coffee Company Inc, Concord, Ontario (CA)

( * ) Notice: Subject to any disclaimer, the term of this patent is extended or adjusted under 35 U.S.C. 154(b) by 703 days.

(21) Appl. No.: 11/464,674

(22) Filed: Aug. 15, 2006

(65) Prior Publication Data

US 2007/0009365 A1 Jan. 11, 2007

Related U.S. Application Data

(63) Continuation-in-part of application No. 10/964,673, filed on Oct. 15, 2004, now Pat. No. 7,494,028.

(60) Provisional application No. 60/572,605, filed on May 20, 2004, provisional application No. 60/511,121, filed on Oct. 15, 2003.

(51) Int. Cl.
*B65D 88/54* (2006.01)

(52) U.S. Cl. ..... 222/333; 222/1; 222/129.1

(58) Field of Classification Search ..... 222/333, 222/1, 129.1–129.4, 146.1, 52, 63, 71; 417/44.1
See application file for complete search history.

(56) References Cited

U.S. PATENT DOCUMENTS

| | | | |
|---|---|---|---|
| 3,651,989 | A | 3/1972 | Westrich |
| 3,756,456 | A | 9/1973 | Georgi |
| 3,756,463 | A | 9/1973 | Gravina |
| 3,887,110 | A | 6/1975 | Porter |
| 4,124,045 | A | 11/1978 | Slywka |
| 4,189,067 | A | 2/1980 | Nottke et al. |
| 4,202,387 | A | 5/1980 | Upton |

(Continued)

FOREIGN PATENT DOCUMENTS

| | | |
|---|---|---|
| DE | 10030788 | 11/2001 |

OTHER PUBLICATIONS

Compraelec, Brochure-Waterpumps—The MP 3 Series of Solenoid Pumps, Undated, p. 15, Strasbourg, France.

(Continued)

*Primary Examiner*—Lien T Ngo
(74) *Attorney, Agent, or Firm*—Bereskin & Parr LLP

(57) ABSTRACT

An apparatus and method for dispensing a discrete volume of fluid. The apparatus includes a pump operable in discrete cycles, a power source connected to the pump, and a controller connected to at least one of the pump and the power source. The controller is configured to vary the power provided from the power source to the pump during at least a portion of each discrete cycle based on characteristics of the pump and the fluid. For example, the controller may vary power by controlling the duration of the provision of power, or by controlling the amplitude of the power. Varying the power is intended to improve the accuracy of the discrete volume of fluid dispensed. Correspondingly, the method of dispensing a discrete volume of fluid includes receiving information pertaining to the fluid to be dispensed, and adjusting a provision of power to a pump based on the information. The method may include adjusting the duration of the provision of power, or adjusting the amplitude of the provision of power.

21 Claims, 19 Drawing Sheets

U.S. PATENT DOCUMENTS 4,309,153 A 1/1982 Panick et al.
4,365,728 A * 12/1982 Tokorozawa et al. ..... 222/209
4,433,795 A 2/1984 Maiefski et al.
4,458,735 A 7/1984 Houman
4,596,558 A 6/1986 Smith et al.
4,886,190 A * 12/1989 Kirschner et al. ..... 222/57
4,910,682 A 3/1990 Wolff et al.
4,938,387 A * 7/1990 Kervefors et al. ..... 222/129.4
4,950,134 A * 8/1990 Bailey et al. ..... 417/383
5,000,357 A 3/1991 Shannon et al.
5,058,780 A 10/1991 Plester et al.
5,068,586 A 11/1991 Kawahara
5,095,710 A 3/1992 Black et al.
5,114,047 A * 5/1992 Baron et al. ..... 222/129.1
5,305,923 A 4/1994 Kirschner et al.
5,332,123 A 7/1994 Farber et al.
5,492,449 A 2/1996 Hunklinger et al.
5,700,401 A 12/1997 Weinberg et al.
5,725,125 A 3/1998 Bessette et al.
5,803,320 A 9/1998 Cutting et al.
6,116,869 A * 9/2000 Couillard et al. ..... 417/442
6,154,605 A * 11/2000 Aonuma ..... 388/829
6,394,312 B1 5/2002 Endou
6,394,424 B2 * 5/2002 Pattullo et al. ..... 261/35
6,435,375 B2 8/2002 Durham et al.
6,457,607 B1 10/2002 Andrea et al.
6,506,030 B1 1/2003 Kottke et al.
6,568,565 B1 5/2003 Scroeder et al.
6,685,054 B2 * 2/2004 Kameyama ..... 222/63
6,811,548 B2 11/2004 Jeffrey
7,063,981 B2 6/2006 Bondestram et al.
7,147,131 B2 * 12/2006 Sher et al. ..... 222/1
7,303,096 B2 * 12/2007 Speight ..... 222/64
2002/0060226 A1 5/2002 Kameyama
2002/0074350 A1 6/2002 Jones et al.
2002/0145008 A1 10/2002 Jones et al.
2004/0056046 A1 3/2004 Jones et al.
2006/0243740 A1 11/2006 Reynolds et al.

OTHER PUBLICATIONS

PCT International Search Report, PCT Application No. PCT/CA2007/001425, dated Dec. 10, 2007.

* cited by examiner

FLUID DISPENSING SYSTEM SUITABLE FOR DISPENSING LIQUID FLAVORINGS

RELATED APPLICATIONS

This application is a continuation-in-part of and claims the benefit of U.S. patent application Ser. No. 10/964,673 filed Oct. 15, 2004, which claims the benefit of U.S. Provisional Patent Application Nos. 60/572,605, filed May 20, 2004 and 60/511,121 filed Oct. 15, 2003, all of which are hereby expressly incorporated herein by reference.

TECHNICAL FIELD

The present invention relates to fluid dispensing systems, and more particularly to fluid dispensing systems suitable for dispensing liquid flavorings.

BACKGROUND

Flavored beverages, for example, flavored coffees, are very popular with consumers. In preparing a flavored beverage, it is possible to add the flavor at various stages, including at an earlier stage in the production of the flavored beverage, for example at a bulk production facility, or at a later stage, such as when the flavored beverage is being dispensed to the consumer. In the following description, the focus is on flavored coffee, however similar principles may be applied to the flavoring of other beverages.

As an example of flavoring earlier in the production process, a particular flavor of coffee may be brewed directly from coffee beans that have been treated with a flavoring liquid. This process has the benefit that it is a somewhat cheaper bulk process, however, oils and essences from such flavored coffee beans can leave residual traces of the flavoring compounds in coffee brewing machines and in the containers used to contain the brewed coffee or to store the unbrewed coffee. The residual traces of the flavoring compounds can negatively affect the perceived taste of other flavors of coffee, and of unflavored coffee brewed with the same brewing machines or stored in the same container at a later time.

Accordingly, in order to avoid cross-contamination of different flavors of coffee with one another, it has been known to use separate machines, or at least separate components (e.g. grinders, pots, thermal containers, filter reservoirs, etc.) for a single machine, to brew and store each flavor of coffee. However, this duplication of equipment increases capital costs, and does not take into account human errors that may lead to different pieces of coffee brewing equipment and/or individual machines being used for multiple flavors of coffee. Also, it can be impractical for individual consumers to purchase different coffee-brewing machines (or components) for each flavor of coffee they may want to consume.

As an example of flavoring at a later stage, flavored coffee can also be produced by adding a liquid or powdered flavoring agent to a cup or pot of unflavored coffee. Highly concentrated flavoring compounds are typically very potent, meaning that minute amounts (e.g. on the order of 0.01 ml and sometimes less) may affect the flavor of an 8 oz beverage. Retail coffee vendors or home consumers do not typically have reliable and practical means for measuring out such small amounts of a concentrated liquid flavoring compound each time a particular flavor of coffee is desired.

Accordingly, concentrated flavoring compounds used to flavor coffee are typically diluted with a suitable carrier, such as ethyl alcohol or propylene glycol. However, ethyl alcohol leads to an intoxicating effect in people when consumed in significant amounts, and also should not be consumed in combination with certain medicines. Furthermore, propylene glycol, in the concentrations commonly used in liquid flavorings, adds an undesirable aftertaste to the flavored coffee or other beverage. It is thus desirable to use as little propylene glycol as possible in a liquid flavoring. In other words, a reduction in the amount of propylene glycol used to dilute a pure flavoring compound to produce a usable liquid flavoring can improve the taste of the beverage to which the flavoring liquid is added since the aftertaste associated with the propylene glycol is also reduced.

One factor affecting how concentrated (or dilute) the flavoring liquid can be in a practical sense for it to be usable in a retail or home environment is the ability to reliably measure out small volumes of the resulting flavoring liquid. Currently available liquid flavoring measuring devices and methods permit retail coffee vendors and home consumers to measure amounts of flavoring liquids that are in the order of several milliliters. Consequently, a typical dose of a commercially available flavoring liquid is on the order of 5 mL, which means that the concentrated flavoring compound has been diluted by a substantial amount of a carrier such as propylene glycol.

Further, particularly in a retail environment, it is important to be able to dispense a consistent amount of flavoring for each cup of coffee produced so that the consumer does not notice any changes in the taste of a particular flavored coffee from time to time. Individual packets of flavoring having the precise amounts needed could be used in such a situation, however, unless a large amount of carrier is used, these packages would be quite small. Further, in a retail environment, it may be time consuming to use individual packages; and a person serving a flavored beverage may not choose the right package for a given cup size, or succeed in placing all of the flavoring from the package directly into the cup, resulting in inconsistencies in the flavoring of a beverage.

As such, there is a need for an improved fluid dispensing system suitable for dispensing liquid flavorings.

SUMMARY

The embodiments if a fluid dispensing system disclosed herein are intended to address at least some of the problems in conventional fluid dispensing systems.

According to one aspect of the embodiments, there is provided a fluid dispensing apparatus for dispensing a fluid. The apparatus includes a pump operable in discrete cycles, such as a diaphragm pump. The pump is intended to pump a discrete volume of fluid on each discrete cycle. The apparatus also includes a power source connected to the pump, and a controller connected to at least one of the pump and the power source. The controller is configured to vary the power provided from the power source to the pump during at least a portion of each discrete cycle based on characteristics of the pump and the fluid. For example, the controller may control the duration or the amplitude of the application of power. Varying the power is intended to improve the accuracy of the discrete volume of fluid that is dispensed.

In some cases, the controller may be configured to vary the power provided by varying the duration of application of power according to a calibrated duration of at least a portion of each discrete cycle. The controller may vary the power during an intake stroke of the pump such that the duration of the application of power is longer than the time required to draw the discrete volume of fluid into the pump. The controller may also vary the power during an expelling stroke of the pump such that the duration of the application of power is longer than the time required to expel the discrete volume of fluid from the pump.

In a particular case, the provision of power from the power source to the pump may cause the pump to draw fluid into the pump. The controller may also be configured to provide power for a duration longer than that required to draw in the discrete volume of fluid into the pump. In such cases, the duration between a first provision of power and a second provision of power may be longer than the time required for the pump to expel the discrete volume of fluid from the pump.

The apparatus may also include an input device in communication with the controller for inputting characteristics of the fluid to be dispensed. The input device may comprise at least one sensor configured to detect a variable associated with the fluid. As an example, the controller may vary the power based on the variable.

The apparatus may also include a power controller, such as a constant current controller, to regulate the power. Regulation of the power is intended to mitigate power fluctuations, which may affect the accuracy of dispensing the fluid.

According to another aspect, there is a method of dispensing a discrete volume of fluid from a pump that is operable in discrete cycles based on a provision of power from a power source. The method includes receiving information pertaining to the fluid to be dispensed and adjusting the provision of power to the pump based on the information. In a particular case, the information may relate to the viscosity of the fluid.

In some cases, the method may include adjusting the duration of the provision of power during at least a portion of each discrete cycle. For example, the provision of power may be longer than the duration of an intake stroke corresponding to drawing the discrete volume of fluid into the pump, or the provision of power may be longer than the duration of an expelling stroke corresponding to expelling fluid from the pump. In some cases the method may include adjusting the amplitude of the provision of power.

In some cases, the method may also include controlling the power supply to apply one polarity of power to the pump during an intake stoke and controlling the power supply to apply an opposite polarity of power to the pump during an expelling stroke.

DETAILED DESCRIPTION

The following provides a description of the types of pumps which may be used for liquid flavoring dispensing and continues with a description of various examples of fluid dispensing systems suitable for dispensing liquid flavoring.

Pumps may generally be classified into two basic types: continuous flow pumps, and reciprocating pumps.

A continuous flow pump is a pump that is by its nature able to maintain a continuous flow of fluid. Such pumps generally rely on some form of continuously rotating impeller. Examples of continuous flow pumps include turbine pumps, propeller pumps, and the Archimedes screw.

A reciprocating pump is a pump that operates in individual discrete cycles, with each cycle moving a discrete, consistent volume of fluid. As its name suggests, a reciprocating pump has a member that reciprocates between two positions. As the member moves from the first position to the second position, it draws a discrete volume of fluid into a pump chamber through an inlet from a fluid source. As the member moves from the second position back to the first position, it drives the fluid from the pump chamber through an outlet. One-way valves can help to prevent fluid from being forced back into the inlet, and can help to prevent expelled fluid from being drawn back into the chamber through the outlet. Examples of reciprocating pumps include piston pumps and diaphragm pumps.

Figure 1B:
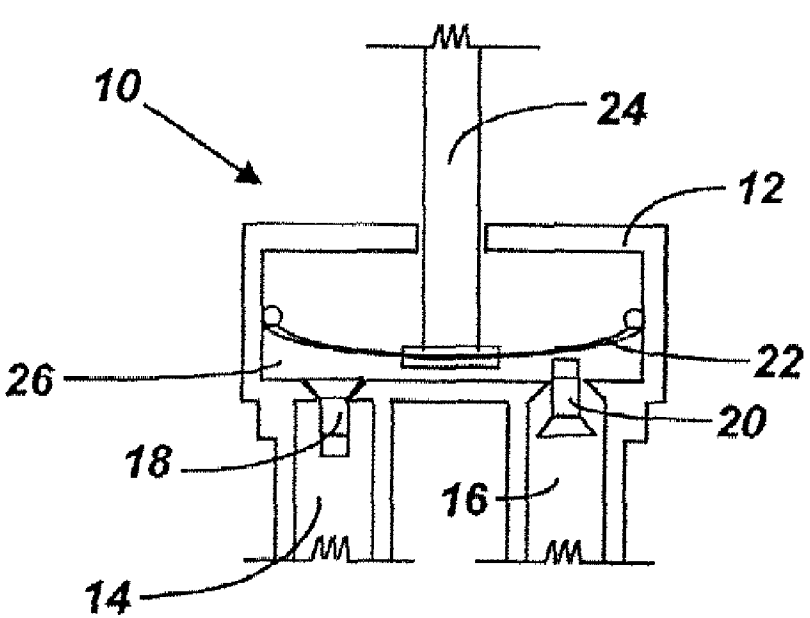
Figure 1b (PRIOR ART)
FIG. 1*b* is a cross sectional view of a prior art diaphragm pump with its diaphragm in a second position.
Figure 1A:
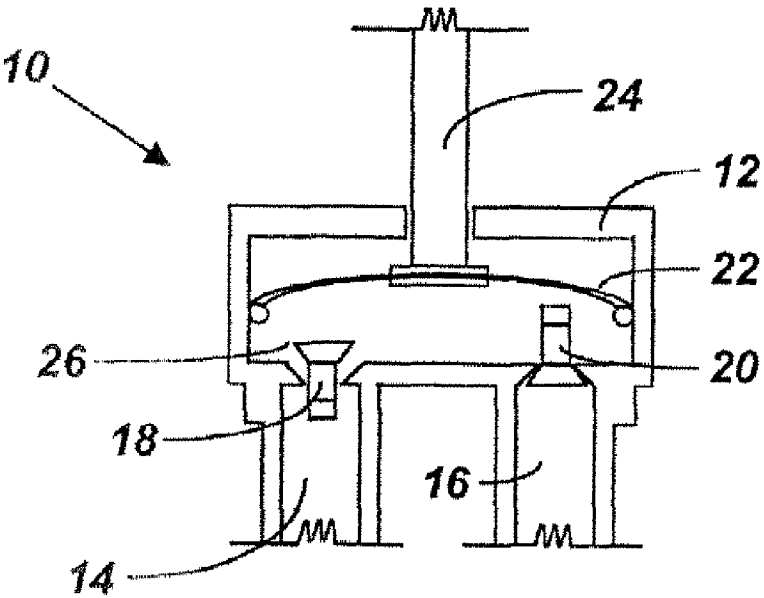
Figure 1a (PRIOR ART)
FIG. 1*a* is a cross sectional view of a prior art diaphragm pump with its diaphragm in a first position.

Referring to FIGS. 1*a* and 1*b*, a diaphragm pump 10 is shown in cross section. The diaphragm pump 10 has a housing 12 having an inlet 14 and an outlet 16. One-way valves 18 and 20 are positioned in the inlet 14 and outlet 16, respectively, and a pump chamber 26 is defined by the internal walls of the housing 12. A flexible diaphragm 22 is secured to the interior side walls of the housing 12 within the pump chamber 26, and is driven between a first position and a second position by a shaft 24. Specifically, FIG. 1*a* shows the diaphragm pump 10 with the diaphragm 22 in a first position, and FIG. 1*b* shows the diaphragm pump 10 with the diaphragm 22 in a second position.

Assuming that the pump 10 has already been primed, when the diaphragm 22 is in the first position (FIG. 1*a*) there will be a specific volume of fluid contained within the pump chamber 26. As the shaft 24 drives the diaphragm 22 into the second position (FIG. 1*b*), the volume of the pump chamber 26 reduces, driving fluid out of the pump chamber 26 through the outlet 16. The one-way valve 18 can help to prevent fluid from being driven out of the inlet 14. As can be seen, the volume of the pump chamber 26 reduces by a certain volume as the diaphragm 22 moves from the first position to the second position. This reduction in volume corresponds to the volume of fluid expelled from the diaphragm pump 10 on each cycle.

As the shaft 24 pulls the diaphragm 22 from the second position (FIG. 1*b*) to the first position (FIG. 1*a*), the volume of the pump chamber 26 increases by approximately the same volume by which it was reduced earlier in the cycle. This results in a suction effect, drawing fluid into the pump chamber 26 through the inlet 14. The one-way valve 20 can help to prevent expelled fluid from being drawn back into the pump chamber 26 through the outlet 16. Again, the volume of fluid drawn into the pump chamber 26 will correspond to the amount by which the volume of the pump chamber 26 has been increased.

Once the diaphragm 22 returns to the first position (FIG. 1*a*) so that the volume of fluid in the pump chamber 26 has been recharged, the diaphragm 22 can again move to the second position (FIG. 1*b*). This will again expel a volume of fluid corresponding to the reduction in volume of the pump chamber 26. Thus, the diaphragm pump 10 can pump a discrete volume of fluid on each cycle.

Figure 2B:
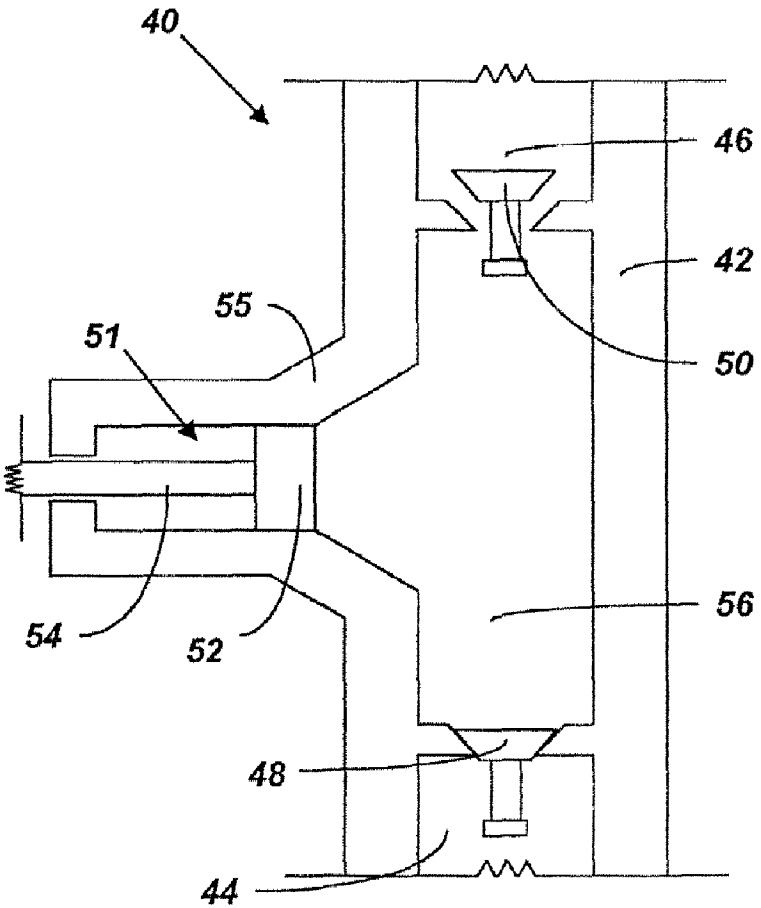
Figure 2b (PRIOR ART)
FIG. 2*b* is a cross sectional view of a prior art piston pump with its piston in a second position.
Figure 2A:
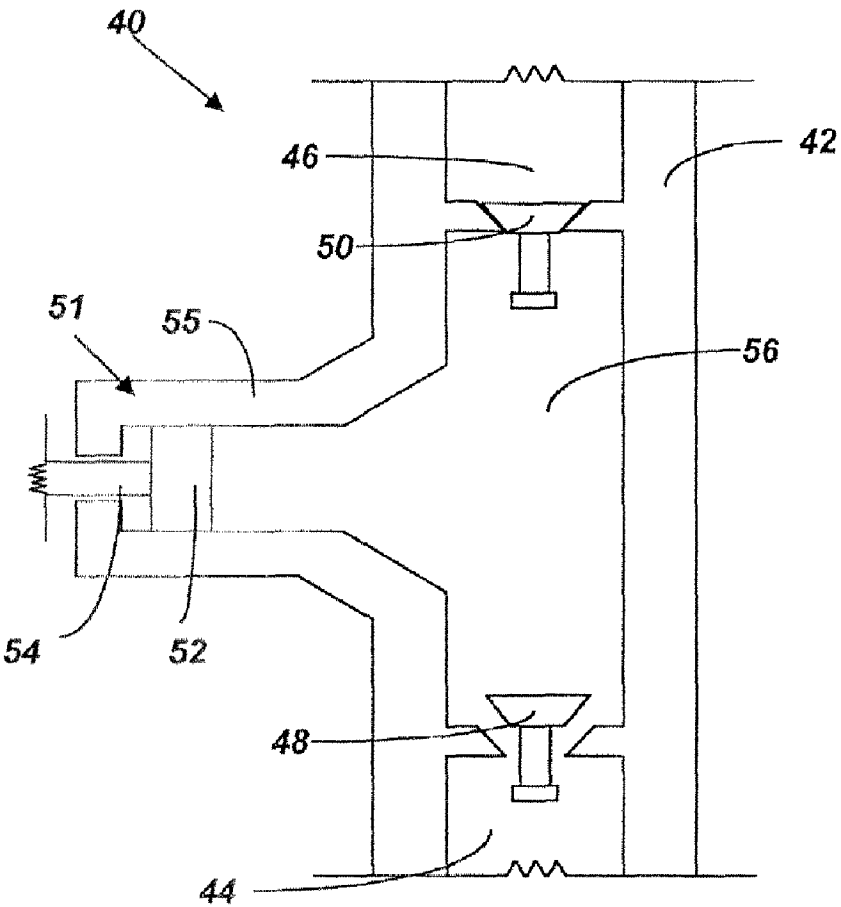
Figure 2a (PRIOR ART)
FIG. 2*a* is a cross sectional view of a prior art piston pump with its piston in a first position.

A piston pump 40 is shown in cross section in FIGS. 2*a* and 2*b*. The piston pump 40 operates on a similar principle to that of the diaphragm pump 10, and comprises a housing 42 having an inlet 44 and an outlet 46. One-way valves 48 and 50 are positioned in the inlet 44 and outlet 46, respectively. A piston 51 comprising a piston head 52 and a piston shaft 54 is slidably received within a piston chamber portion 55 of the pump chamber 56 defined by the internal walls of the housing 42. The piston head 52 sealingly engages the interior wall of the piston chamber portion 55. One skilled in the art will appreciate that some very small degree of leakage may occur between the piston head 52 and the interior wall of the piston chamber portion 55 if the piston head 52 is to slide therewithin. However, such leakage is generally not be large enough to affect the accuracy of the piston pump 40.

In operation, the piston 51 reciprocates between the first position, shown in FIG. 2*a*, and the second position, shown in FIG. 2*b*. Assuming that the piston pump 40 has been primed, a volume of fluid will be contained within the pump chamber 56. As the piston 51 moves from the first position to the second position, the piston head 52 slides along the interior wall of the piston chamber portion 55, thereby reducing the overall volume of the pump chamber 56. This expels a corresponding volume of fluid from the pump chamber 56 through the outlet 46. The one-way valve 48 can help to prevent fluid from being forced back into the inlet 44.

As the piston 51 moves from the second position back to the first position, the volume of the pump chamber 56 increases, resulting in a suction effect that draws fluid through the inlet 44 into the pump chamber 56. The one-way valve 50 can help to prevent fluid from being drawn back into the pump chamber 56 from the outlet 48.

Once the piston 51 returns to the first position (FIG. 2*a*) the volume of fluid in the pump chamber 56 will be recharged. The piston 51 can then be moved back into the second position (FIG. 2*b*), again expelling a volume of fluid corresponding to the reduction in volume of the pump chamber 56. Thus, like the diaphragm pump 10, the piston pump 40 can pump a discrete volume of fluid on each cycle.

The source of motive force for the shaft 24 or piston 51 may be a solenoid, or flywheel driven by a stepping motor, or some other source of motive force permitting the pump 10 or 40 to be controllably operated one cycle at a time.

It will be appreciated that the diaphragm pump 10 and the piston pump 40 are provided as examples only, and that other reciprocating pumps are also available.

One useful version of a reciprocating pump is a modified reciprocating pump in which the portion of the cycle during which fluid is expelled is divided into sub-cycles. Now referring to FIGS. 3*a* to 3*d*, a modified version of a piston pump, which may also be referred to as a modified syringe pump or modified infusion pump, is shown generally at 70.

The modified infusion pump 70 includes a housing 72, an inlet 74, and an outlet 76. One-way valves 78, 80 are positioned in the inlet 74 and outlet 76, respectively. A piston 81 comprising a piston head 82 and a shaft 84 is slidably received within a pump chamber 86 defined by the housing 72. The piston head 82 sealingly engages the interior wall of the pump chamber 86 defined by the housing 72. As with the piston pump 40, it is understood that some small amount of leakage may occur, although not in amounts that generally affect the accuracy of the pump 70.

Figure 3B:
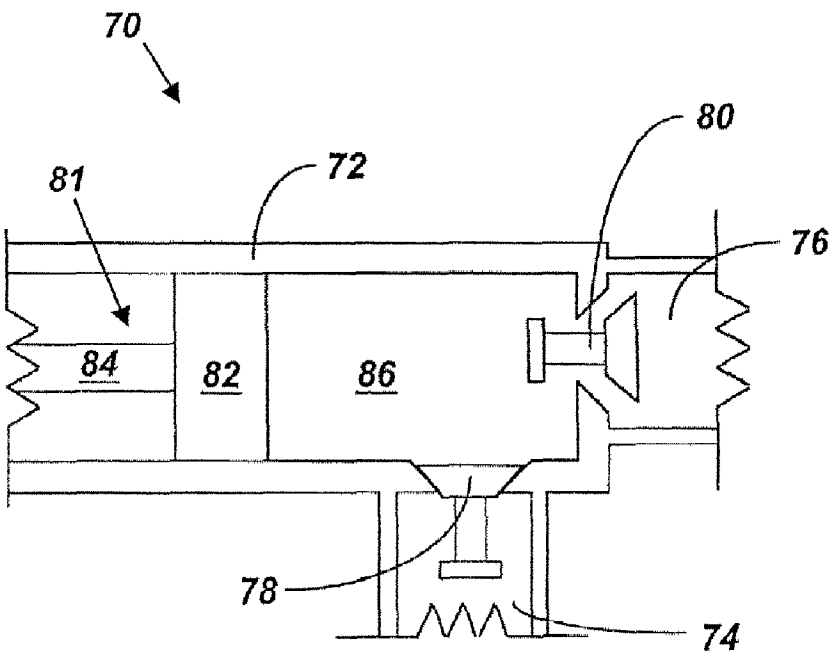
FIG. 3*b* is a cross sectional view of a modified infusion pump with its piston having advanced incrementally from a retracted position.
Figure 3A:
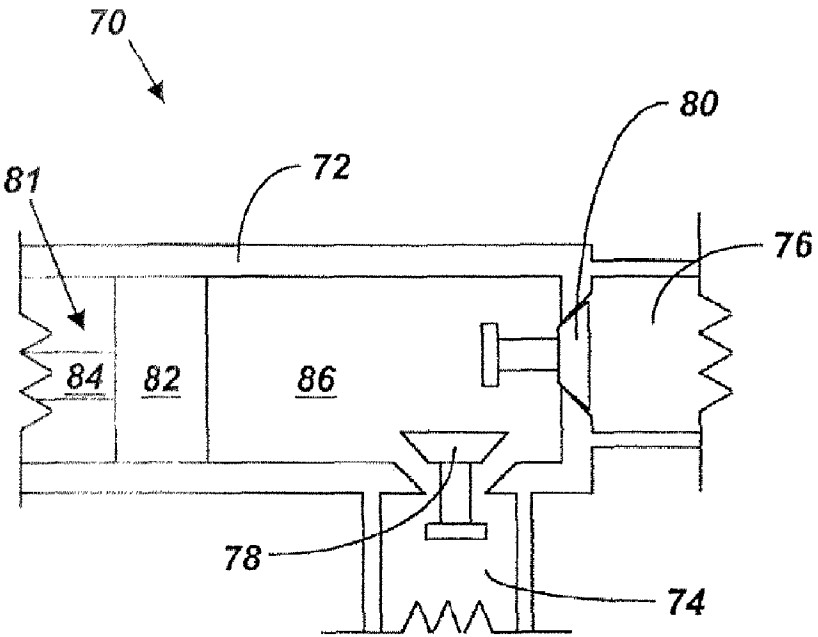
FIG. 3*a* is a cross sectional view of a modified infusion pump with its piston in a retracted position.
Figure 3D:
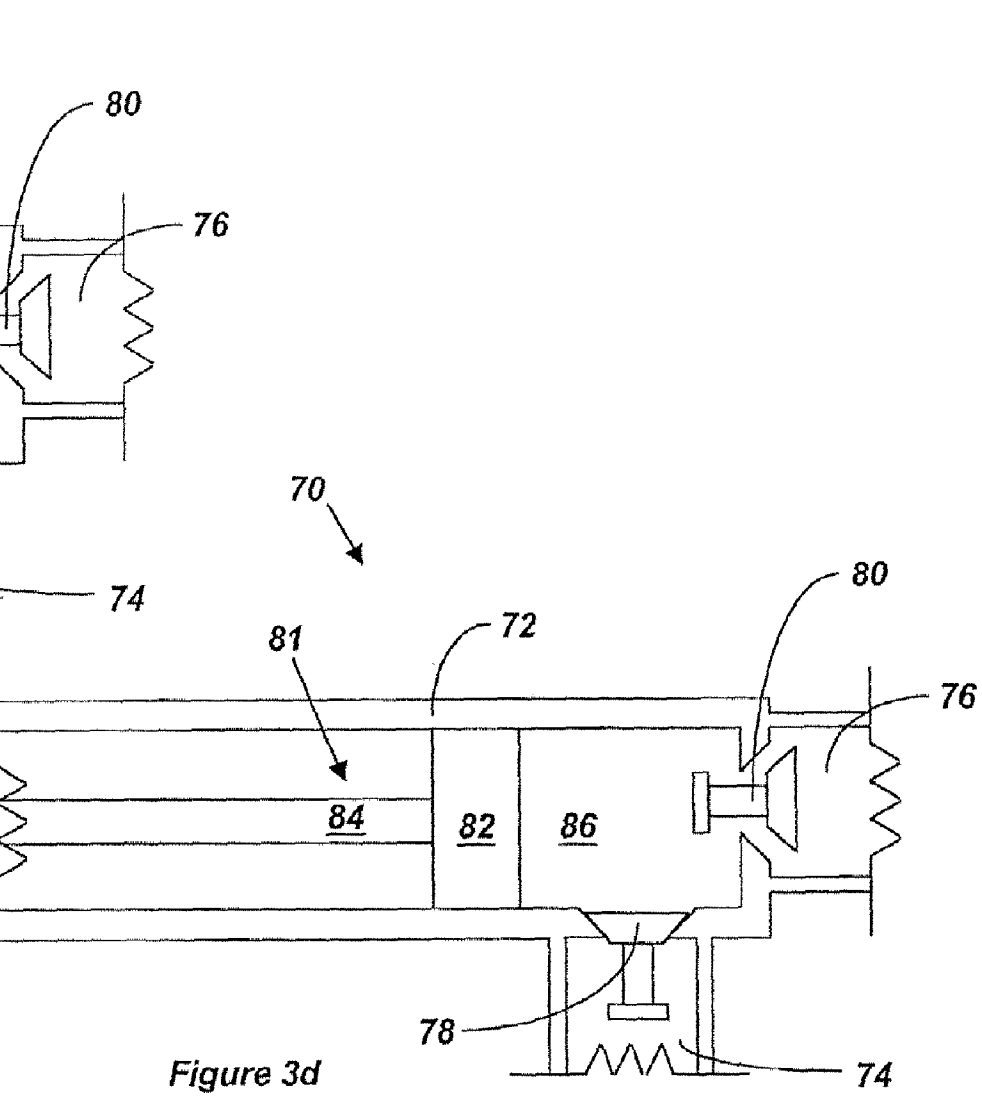
FIG. 3*d* is a cross sectional view of a modified infusion pump with its piston in a fully extended position.

Referring now specifically to FIG. 3*a*, the modified infusion pump 70 is shown with the piston 81 in a first position, i.e. the piston 81 is fully retracted so that the volume of the pump chamber 86 is at a maximum. If the modified infusion pump 70 has been primed, then the interior volume of the pump chamber 86 will be filled with fluid. With reference now to FIG. 3*d*, the modified infusion pump 70 is shown with the piston 51 in a second position, i.e. the piston 81 is in a fully extended position so that the volume of the pump chamber 86 is at a minimum. As the piston 81 moves from the fully retracted position shown in FIG. 3*a* through the positions shown in FIGS. 3*b* and 3*c* to the fully extended position shown in FIG. 3*d*, a discrete volume of fluid is expelled through the outlet 76. The one-way valve 78 can help to prevent fluid from being forced into the inlet 74. The piston 81 may then move from the second position shown in FIG. 3*d* back to the first position shown in FIG. 3*a*, to draw fluid into the pump chamber 86 through the inlet 74. The one-way valve 80 can help to prevent expelled fluid from being drawn back into the pump chamber 86 through the outlet 86. Accordingly, the modified infusion pump 70 is able to expel a discrete volume of fluid as the piston 81 moves from its first position (FIG. 3*a*) to its second position (FIG. 3*d*).

Because each cycle pumps a discrete volume of fluid, the volume of fluid dispensed can be controlled with an appropriate degree of precision by controlling the number of cycles over which the pump is operated. For example, if the pump 70 operates at a rate of 0.01 cubic centimeters (cc) per cycle, then a volume representing any multiple of 0.01 cc can be dispensed by operating the pump over that multiple of cycles. For example, a volume of 0.24 cc could be dispensed by operating the pump 70 over 24 cycles, and a volume of 0.36 cc could be dispensed by operating the pump over 36 cycles.

Figure 4:
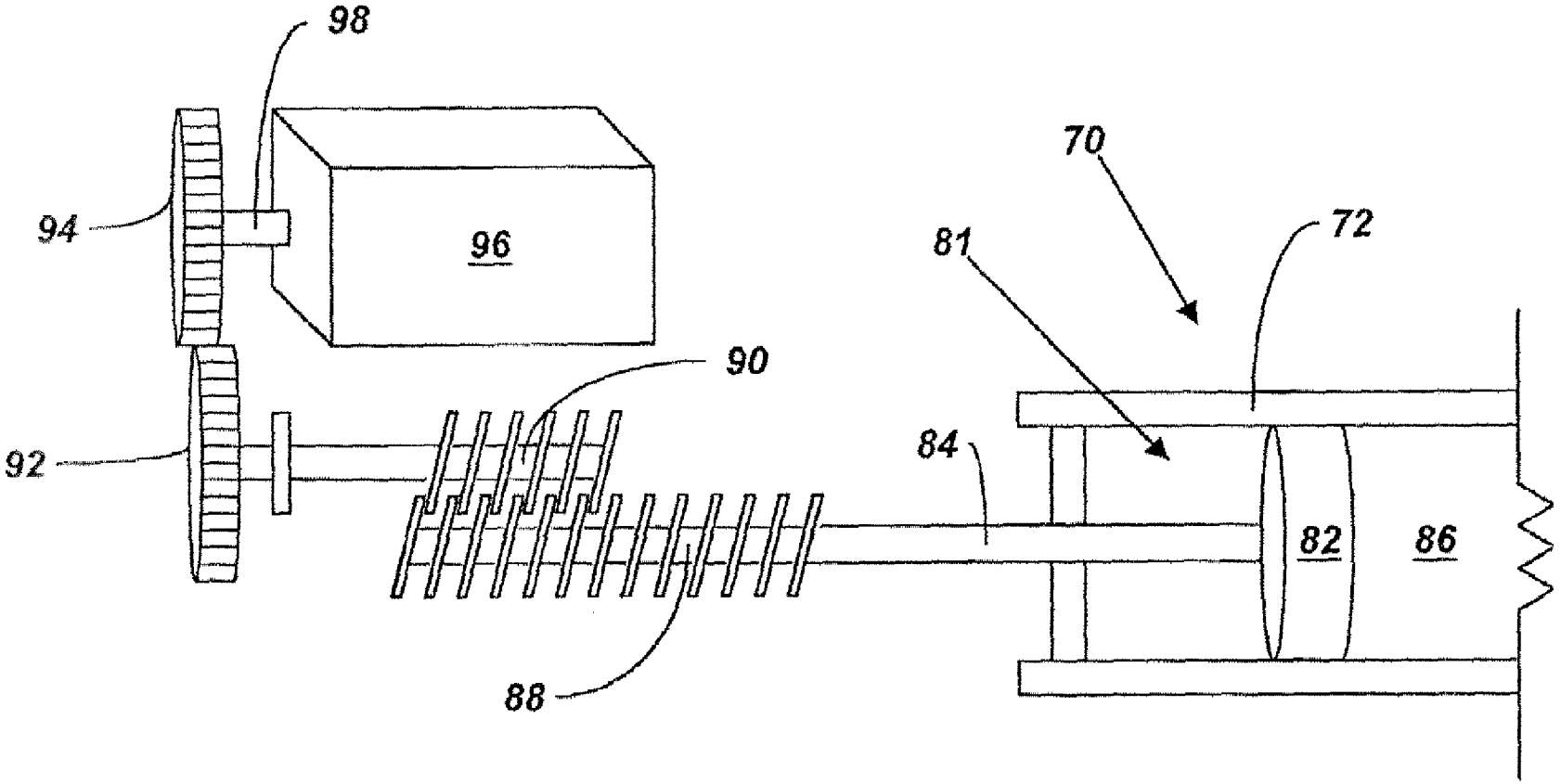
FIG. 4 is a cut-away view of a portion of a first drive mechanism for a modified infusion pump.

Now referring to FIG. 4, in another version of the modified infusion pump 70, at least a portion 88 of the shaft 84 of the piston 81 is threaded. The threaded portion 88 of the shaft 84 meshes with a threaded rod 90. The threaded rod 90 is driven by a first gear 92, which meshes with and is driven by a second gear 94. The second gear 94 is driven by a stepping motor 96 having a drive shaft 98. Thus, when the stepping motor 96 is actuated to drive the drive shaft 98, the drive shaft 98 drives the second gear 94, the second gear 94 drives the first gear 92, which in turn drives the threaded rod 90 to rotate. Because the threaded rod 90 meshes with the threaded portion 88 of the shaft 84, rotation of the threaded rod 90 causes the shaft 84, and therefore the piston 81, to either advance or retract relative to the pump chamber 86. Whether the piston 81 advances or retracts depends on the direction of rotation of the drive shaft 98.

Figure 3C:
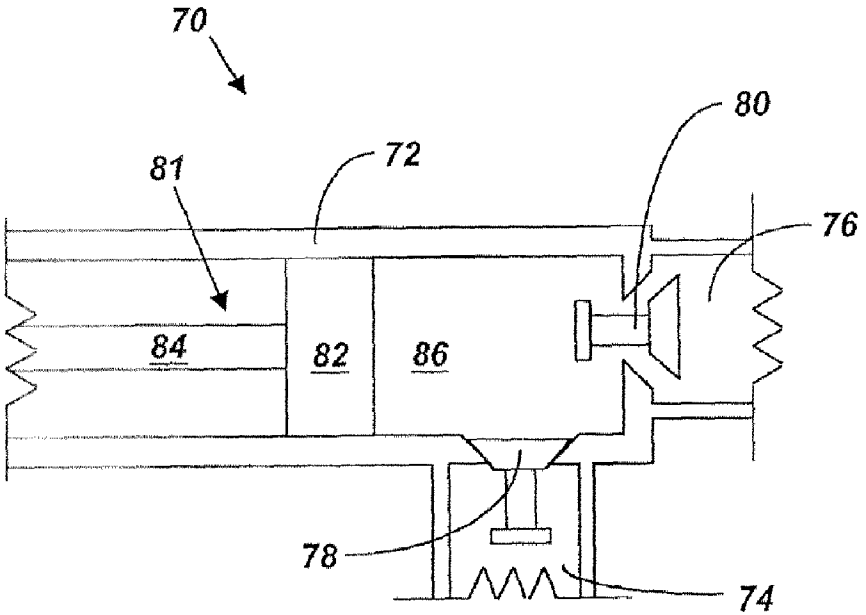
FIG. 3*c* is a cross sectional view of a modified infusion pump with its piston having advanced incrementally from the incremented position in FIG. 3*b;*

Through the use of a stepping motor and precise gearing among the gears 92, 94 and the threaded rod 90, it is possible to advance the piston 81 incrementally into the pump chamber 86. In particular, a single complete revolution of the drive shaft 98 can result in the piston 81 moving a discrete distance into the pump chamber 86, as shown in FIG. 3*b*, although generally not all the way into the second position shown in FIG. 3*d*. This discrete movement results in a discrete reduction in the volume of the pump chamber 86, in turn resulting in a discrete volume of fluid being expelled through the outlet 76. Moving the drive shaft 98 through another complete revolution can cause the piston 81 to advance further into the pump chamber 86 by a similar discrete distance, as shown in FIG. 3*c*, resulting in a similar discrete volume of fluid being expelled through the outlet 76. By selecting appropriate gearing, the piston 81 can be made to advance into the pump chamber 86 by any desired distance upon a complete revolution of the drive shaft 98 of the stepping motor 96.

The modified infusion pump 70 permits various volumes of fluid to be selectively dispensed. For example, in a particular embodiment of the modified infusion pump 70, upon each revolution of the drive shaft 98, the piston 81 may advance into the pump chamber 86 by a distance corresponding to the expulsion of 0.01 cc of fluid through the outlet 76. It is then possible to dispense volumes of fluid in multiples of 0.01 cc by controlling the number of revolutions of the drive shaft 98. Moving the drive shaft 98 through 24 complete revolutions will advance the piston 81 the appropriate distance to expel 0.24 cc of fluid through the outlet 76.

In the modified infusion pump 70, after the desired quantity of fluid has been expelled, or the piston 81 has reached the second position shown in FIG. 3*d*, the piston 81 can be retracted back to the first position as shown in FIG. 3*a*. This increases the volume of the pump chamber 86 and creates a suction effect to draw fluid into the pump chamber 86 through the inlet 74, thereby refilling the pump chamber 86. The one-way valve 80 can help to prevent expelled fluid from being drawn back into the pump chamber 86 through the outlet 76. Retraction of the piston 81 could be achieved by rotating the drive shaft 98 in the opposite direction to that used to advance the piston 81, for the same number of rotations.

One skilled in the art will appreciate that the discrete advances of the piston 81 into the pump chamber 86 need not be tied to a complete revolution of the drive shaft 98. If the stepper motor 96 is sufficiently accurate, each discrete advance of the piston 81 into the pump chamber 86 may be achieved by a fraction of a complete revolution of the drive shaft 98.

Figure 5:
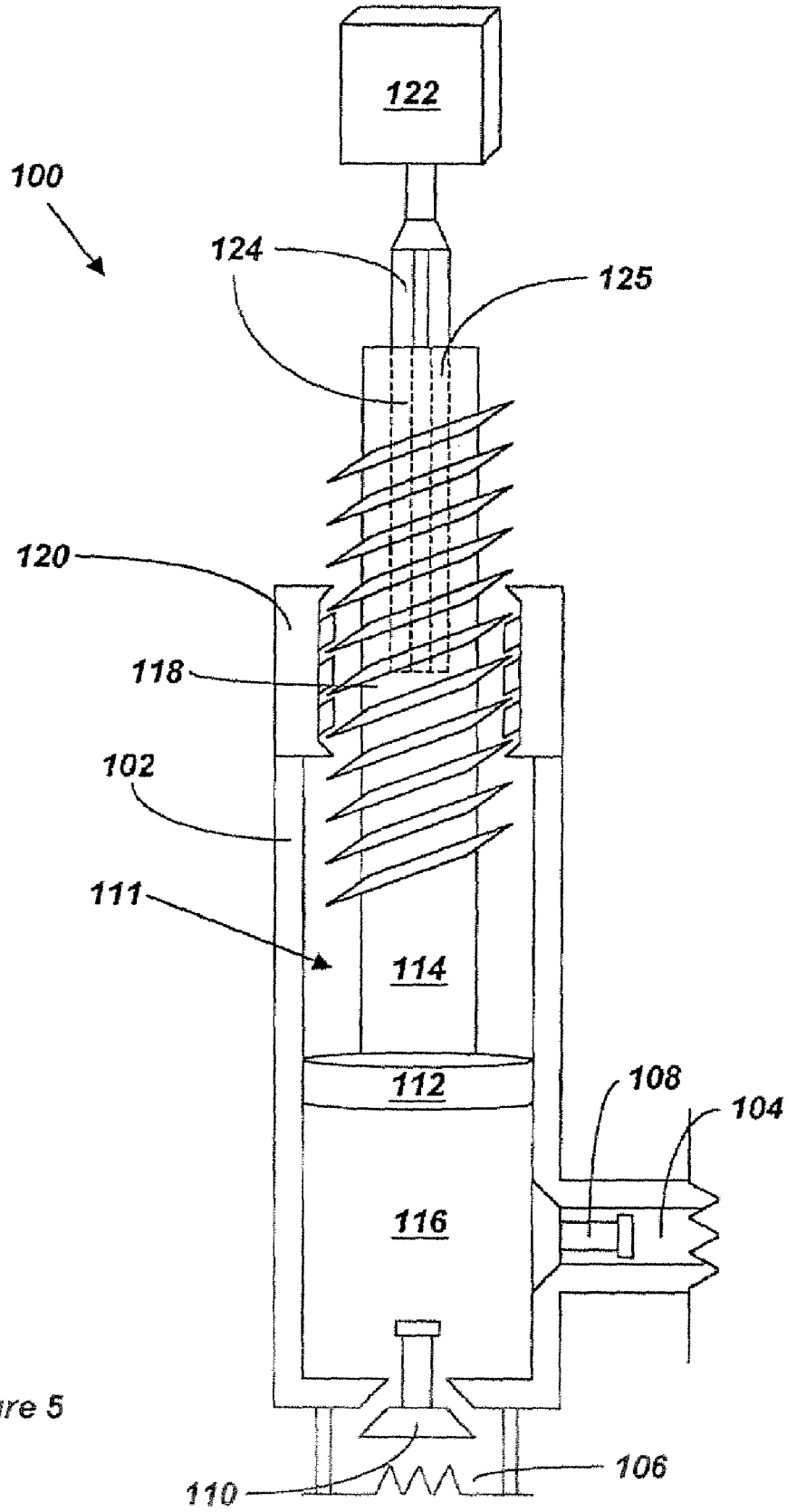
FIG. 5 is a cut-away view of a portion of a second drive mechanism for a modified infusion pump.

With reference now to FIG. 5, a gearing mechanism for an alternate embodiment of a modified infusion pump 100 is shown. The modified infusion pump 100 comprises a housing 102, an inlet 104 and an outlet 106. A one way valve 108 is positioned in the inlet 104, and a one-way valve 110 is positioned in the outlet 108. A piston 111 comprising a piston head 112 and a shaft 114 is slidably received within a pump chamber 116 defined by the interior walls of the housing 102. The piston head 112 sealingly engages the inner wall of the pump chamber 116. Again, although minor leakage may occur, such leakage generally does not affect the accuracy of the pump 100.

A portion 118 of the shaft 114 is threaded. This threaded portion 118 meshes with a threaded collar 120, which may form part of the housing 102. A stepper motor 122 drives a drive shaft 124, which extends into an axial cavity 125 (shown by dashed lines) in the shaft 114 to drive the shaft 114 to rotate. As the shaft 114 rotates, the meshing of the threaded portion 118 with the threaded collar 120 causes the shaft 114, and therefore the piston 111, to advance axially into the pump chamber 116. This results in a reduction of the volume of the pump chamber 116, causing fluid contained within the pump chamber 116 to be expelled through the outlet 106. The one-way valve 108 can help to prevent fluid from being expelled through the inlet 104. The use of calibrated threading on the threaded portion 118 of the shaft 114, and on the threaded collar 120, permits the distance of linear advancement of the piston 111 to be correlated to the revolutions of the drive shaft 124. Thus, one complete revolution of the drive shaft 124 corresponds to advancement of the piston 111 by a given distance, which in turn results in the displacement of a given volume of fluid. The volume of fluid being displaced can thereby be controlled by controlling the number of revolutions, or fractions of revolutions, of the drive shaft 124.

In a manner similar to that described for the modified infusion pump 70, after the desired volume of fluid has been displaced, the pump chamber 116 can be recharged by driving the stepping motor 122 in a reverse direction until the piston 111 has been completely retracted. This increases the volume of the pump chamber 116, resulting in a suction effect that draws fluid into the pump chamber through the inlet 104, thereby refilling the pump chamber. Fluid that has been expelled generally does not flow back into the pump chamber 116 through the outlet 106 because of the one-way valve 110.

Because the piston 111, and therefore the shaft 114, advance and retract axially relative to the housing 102, the drive shaft 124 cannot be fixedly secured within the axial cavity 125 on the shaft 114, as this would interfere with axial movement of the piston 111. For this reason, the drive shaft 124 is slidably received within the axial cavity 125, thereby permitting the shaft 114, and therefore the piston 111, to move axially relative to the drive shaft 124 and stepper motor 122. The drive shaft 124 has a cross-sectional shape permitting it to interlock with the correspondingly shaped axial cavity 125 so that it can drive the shaft 114 rotationally even as the shaft 114 slides axially relative to the drive shaft 124. In the particular embodiment shown, both the drive shaft 124 and the axial cavity 125 have a cross shape. One skilled in the art will appreciate that any appropriate shape may be used, so long as it permits the shaft 114 to be rotationally driven by the drive shaft 124 while sliding axially relative to the drive shaft 124.

Fluid Dispensing System Incorporating "Discrete Volume" Pumps

Simple reciprocating pumps, including but not limited to the diaphragm pump 10 and the piston pump 40, as well as incrementally operable reciprocating pumps in which the fluid expulsion portion of the primary cycle has been broken down into smaller discrete fluid expulsion sub-cycles, including but not limited to the modified infusion pumps 70 and 100, are typically referred to herein as "discrete volume" pumps. This is because these types of pumps are all operable to dispense a discrete volume of fluid in response to a pulse. In some embodiments, the pulse may be an electrical signal pulse.

By using a fluid dispensing system that incorporates a discrete volume pump, it is possible to accurately dispense small volumes of fluid in a consistently repeatable manner.

Figure 6:
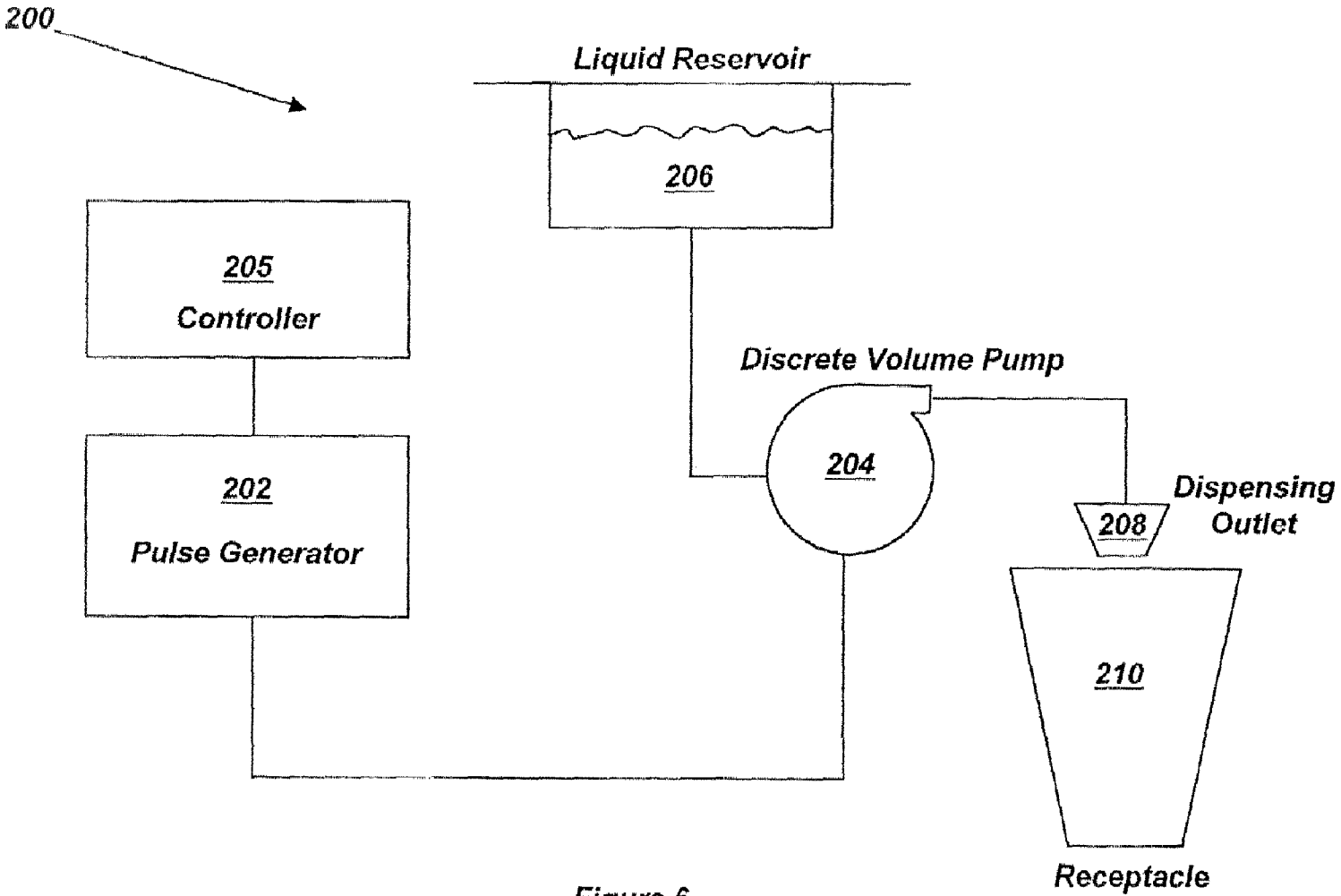
FIG. 6 is a schematic diagram of a fluid dispensing system according to an exemplary embodiment.

Reference is now made to FIG. 6, which is a schematic diagram of the basic elements of an example of a fluid dispensing system 200 in accordance with an exemplary embodiment. A pulse generator 202 is operably coupled to a discrete volume pump 204. The pulse generator 202 is optionally controlled by a controller 205. In the case of a simple reciprocating pump, pulses generated by the pulse generator 202 can drive the discrete volume pump 204 to operate through a discrete number of cycles. In the case of an incrementally operable discrete volume pump, such as the modified infusion pumps 70, 100, each pulse can drive the discrete volume pump 204 to operate through a discrete number of sub-cycles. Each sub-cycle being part of the portion of the cycle during which fluid is expelled from the discrete volume pump 204. The pulse generator 202 and controller 205 are described in greater detail below.

The discrete volume pump 204 has an inlet (not shown) connectible, and in this case connected in fluid communication with a liquid reservoir 206. The discrete volume pump 204 has an outlet (not shown) in fluid communication with a dispensing outlet 208. A receptacle 210 may be positioned to receive fluid dispensed from the dispensing outlet 208.

In general, fluid dispensing system 200 operates as follows. The discrete volume pump 204 and connecting tubing (not shown) are first primed. The pulse generator 202 then generates a pulse that drives the discrete volume pump 204 to operate over a preset number of cycles or sub-cycles. Typically, the discrete volume pump 204 operates over one cycle or sub-cycle in response to a single pulse.

For a simple discrete volume pump 204 (e.g. the diaphragm pump 10 or the piston pump 40), as the discrete volume pump 204 operates through the preset number of cycles, it can draw a predetermined volume of fluid out of the reservoir 206 and pump a corresponding volume of fluid through the dispensing outlet 208. For an incrementally operable discrete volume pump 204 (e.g. the modified infusion pumps 70, 100), the discrete volume pump 204 dispenses a predetermined volume of fluid from within its pump chamber over a number of sub-cycles based on a number of pulses. After the fluid has been dispensed, a number of pulses of a second type may be provided by the pulse generator 202 to drive the incrementally operable discrete volume pump 204 to return to its "home" position (e.g. with its piston fully retracted) and thereby recharge its pump chamber. Generally, the number of pulses of the second type corresponds to the number of pulses initially provided, so that the incrementally operable discrete volume pump 204 will increment toward its "home" position by the same number of increments by which it was initially incremented away from its "home" position.

Regardless of whether a simple or incrementally operable discrete volume pump 204 is used, the volume of fluid dispensed may be varied by varying the number of pulses provided to the discrete volume pump 204 by the pulse generator 202. Thus, if a fluid dispenser 200 is used, for example, to dispense liquid flavoring into a beverage, the volume of liquid flavoring dispensed could be varied depending on the size of the beverage being flavored.

One skilled in the art will appreciate that the terms "pulse" and "pulse generator" are used in their broadest possible sense. Thus, the pulse generator 202 may be an electronic pulse generator that transmits electrical pulses, or it may be a mechanical pulse generator providing discrete mechanical "pulses".

For example, a hand crank (not shown) that makes a clicking noise after each complete revolution may be mechanically coupled to the discrete volume pump 204 so that one revolution of the hand crank drives the discrete volume pump 204 through one complete cycle or sub-cycle. By counting the number of clicks, a user would be able to control the number of cycles or sub-cycles executed by the discrete volume pump 204, and thereby control the total volume of fluid dispensed. In the case of an incrementally operable discrete volume pump 204, such a hand crank could be configured so that driving the hand crank in a in a first direction may drive the discrete volume pump through at least one sub-cycle. Driving the hand crank in a second direction may return the discrete volume pump 204 to its "home" position and thereby recharge the pump chamber.

Although a mechanical pulse generator may be used in the fluid dispenser 200, the use of an electronic pulse generator can be advantageous. In some embodiments, the pulse generator may be integrated with a controller, as will be described in greater detail below. This permits various types of control features to be integrated into the fluid dispensing system 200 to control the number of pulses in response to different variables. For example, if the fluid dispensing system 200 is used to dispense liquid flavoring into a beverage, the density of the liquid flavoring may change, for example as the temperature changes, and a greater or lesser volume of liquid flavoring may be required to achieve the same flavoring effect as with dispensing a liquid flavoring with a constant density. Similarly, different liquid flavorings may each have a different flavor concentration, so a different number of cycles or sub-cycles may be required for different types of flavors. In another example, the viscosity of the liquid flavoring may change with temperature and the pump may require alternative cycle timing, amounts of power, or a different number of cycles, to dispense the same volume as would be pumped with a fluid having a constant viscosity. The use of a controller as the pulse generator 202 allows these variables, and others, to be taken into account.

The pump 204 may be coupled to a power source (not shown), with each pulse transmitted from the pulse generator 202 causing the pump to draw power from the power source and execute a preset number of cycles or sub-cycles.

Alternatively, the controller may be operable to selectively permit and prevent the transmission of discrete electrical pulses, for example in the form of a sinusoidal wave from a power source, such as 60 Hz AC power, to the discrete volume pump 204. In this case, the power source (as controlled by the controller) can be considered the pulse generator. The electrical pulses supplied to the pump 204 may provide the source of motive power to the pump 204, so that the pulse provides the power needed for the pump 204 to execute one or more cycles. For example, the duration of the pulse (and therefore the time period during which power is supplied to the pump 204) may be made longer than the time period required to execute the preset number of cycles or sub-cycles. This may, for example, reduce the possibility that the pump will stop mid-cycle due to a lack of power. The pump 204 may be configured with switching means to prevent the pump 204 from executing additional cycles or sub-cycles beyond the preset number, even while power is still being applied, until the power applied has dropped to zero (i.e. the first pulse has ended) and risen again (i.e. the next pulse has begun). A similar controller may be implemented with other power sources, such as a DC power source that generates discrete pulses in the form of square waves. In this case, the controller may modify characteristics of the DC square waves, such as, the duration of a pulse, the amplitude of motive power supplied to the pump, or the frequency of pulses. In some embodiments, pump 204 can be energized using a DC fixed current, or DC fixed voltage pulse applied for a specified duration and with specified delays between pulses.

One particular advantageous application of a fluid dispensing system according to the embodiments is as a liquid flavoring dispenser.

FIRST EXAMPLE OF A LIQUID FLAVORING DISPENSER

Figure 7:
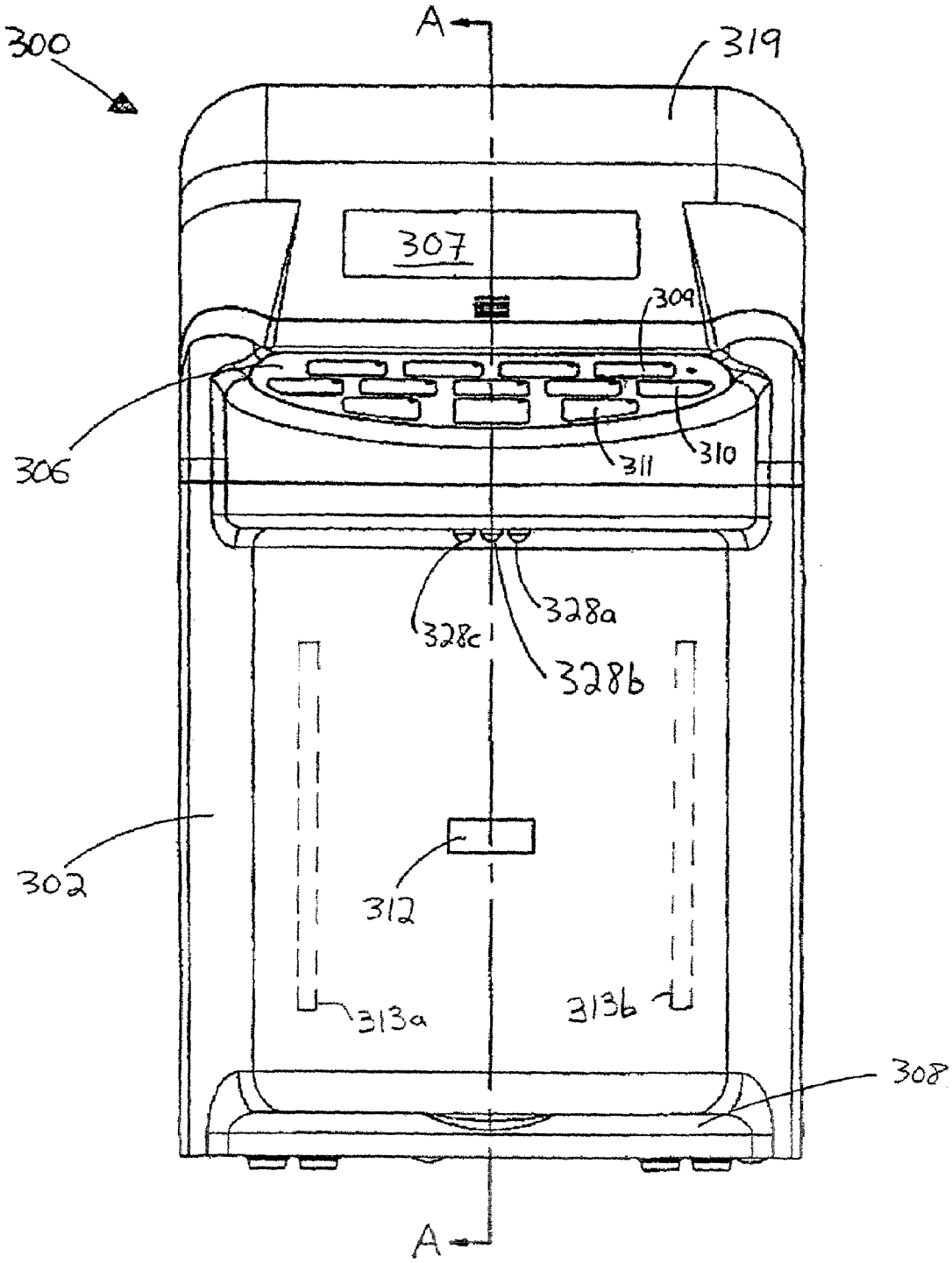
FIG. 7 is a front view of a fluid dispensing system according to another exemplary embodiment.
Figure 8:
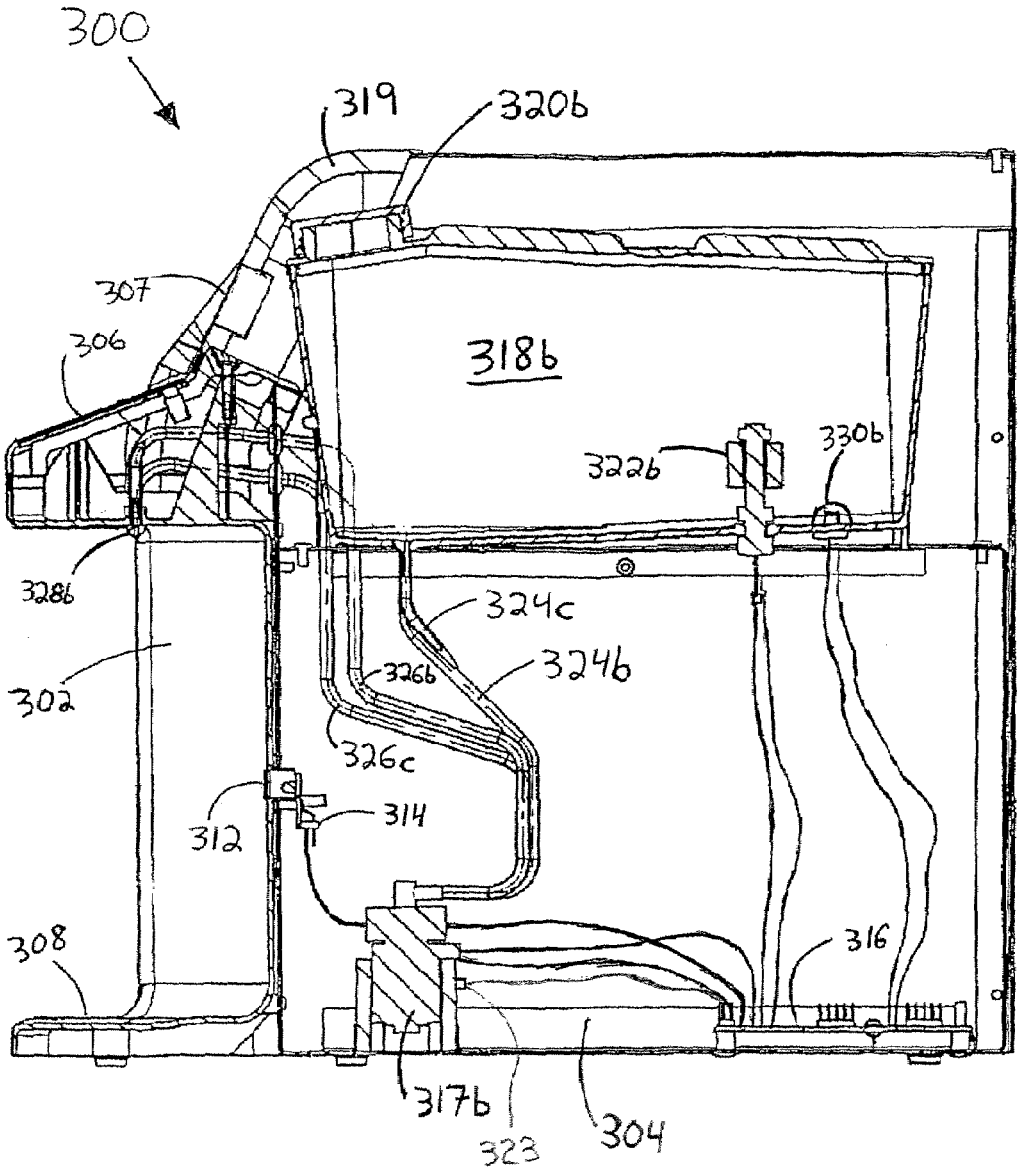
FIG. 8 is a cross sectional view of the fluid dispensing system of FIG. 7, taken along the line A-A.

Now referring to FIGS. 7, 8, 9 and 10, a first example of a liquid flavoring dispenser 300 is shown. FIG. 7 shows a front view of the dispenser 300, and FIG. 8 shows a side cross sectional view. The liquid flavoring dispenser 300 comprises a front housing 302 and a rear housing 304. The front housing 302 has a keypad 306, a display 307 and a cup support 308. The cup support 308 may optionally include a removable drip tray (not shown). The keypad 306 may have a plurality of drink selection keys 309, a plurality of size selection keys 310, and a plurality of flavor selection keys 311.

One skilled in the art will appreciate that the display 307 may be an LCD display, or any other suitable electronic display, and will also appreciate that the display 307 is optional, and may be omitted if desired. In addition, the keys 309, 310 and 311 may be provided with associated light emitting diodes (LEDs) to indicate when a particular key 309, 310, 311 has been depressed. It will be apparent to one skilled in the art that if such LEDs are provided, they may also be used as an alternative to the display 307. For example, different patterns of flashing or constantly illuminated LEDs may be used to alert a user to various possible fault conditions. Audible alarms may also be used.

The front housing 302 may also be provided with an infrared sensor 312 coupled to an infrared control unit 314. The infrared sensor 312 can detect the presence of a cup, and through the operation of the infrared control unit 314 can transmit a signal indicative of the presence or absence of a cup. The dispenser 300 may thereby be prevented from dispensing liquid flavoring if no cup is present to receive it. Alternatively, the front housing 302 may be provided with a cup sensor array 313 (i.e. infrared array) that may detect the presence of a cup and also detect the particular size of cup (e.g. small, medium, large, or extra-large) placed on the cup support 308. As shown in FIG. 7 in dashed lines, such a sensor array 313 may include an emitter array 313*a* on one side of the front housing 302 and a receiver array 313*b* on the opposite side of the front housing 302. When activated, the receiver array 313*b* generally only receives signals from elements of the emitter array 313*a* that are not blocked by the placement of a cup.

A controller 316 is generally situated in the rear housing 304, and is operably connected to the keypad 306, the display 307, the infrared control unit 314, and to a discrete volume pump 317 that may also be positioned in the rear housing 304. One suitable pump is an MP 3 solenoid diaphragm pump (available from Compraelec, 29 rue Joseph Guerber, 67100 Strasbourg, France). Of course, other suitable pumps may also be used.

The controller 316 may be adapted to receive signals from the infrared control unit 314, as described above, to indicate the presence or absence of a cup. Optionally, the infrared sensor 312 may also permit the controller 316 to prevent dispensing of additional liquid until the cup has been removed and replaced with a new cup, to reduce the likelihood of accidental over-flavoring. In the case where a cup sensor array 313 is provided, the controller 316 may be adapted to receive signals from the cup sensor array 313 and determine a cup size. The infrared sensor 312 and infrared control unit 314 may also be configured to permit the controller 316 to communicate with a Personal Digital Assistant (PDA), as will be described further below.

The controller 316 may also be adapted to receive signals from the keypad 306, and transmit messages to the LEDs in the keypad 306, or to the display panel 307. A power source (not shown) is also connected to the controller 316. Details of the operation of the controller 316, and how it controls the operation of the dispenser 300, are set out below.

Figure 9:
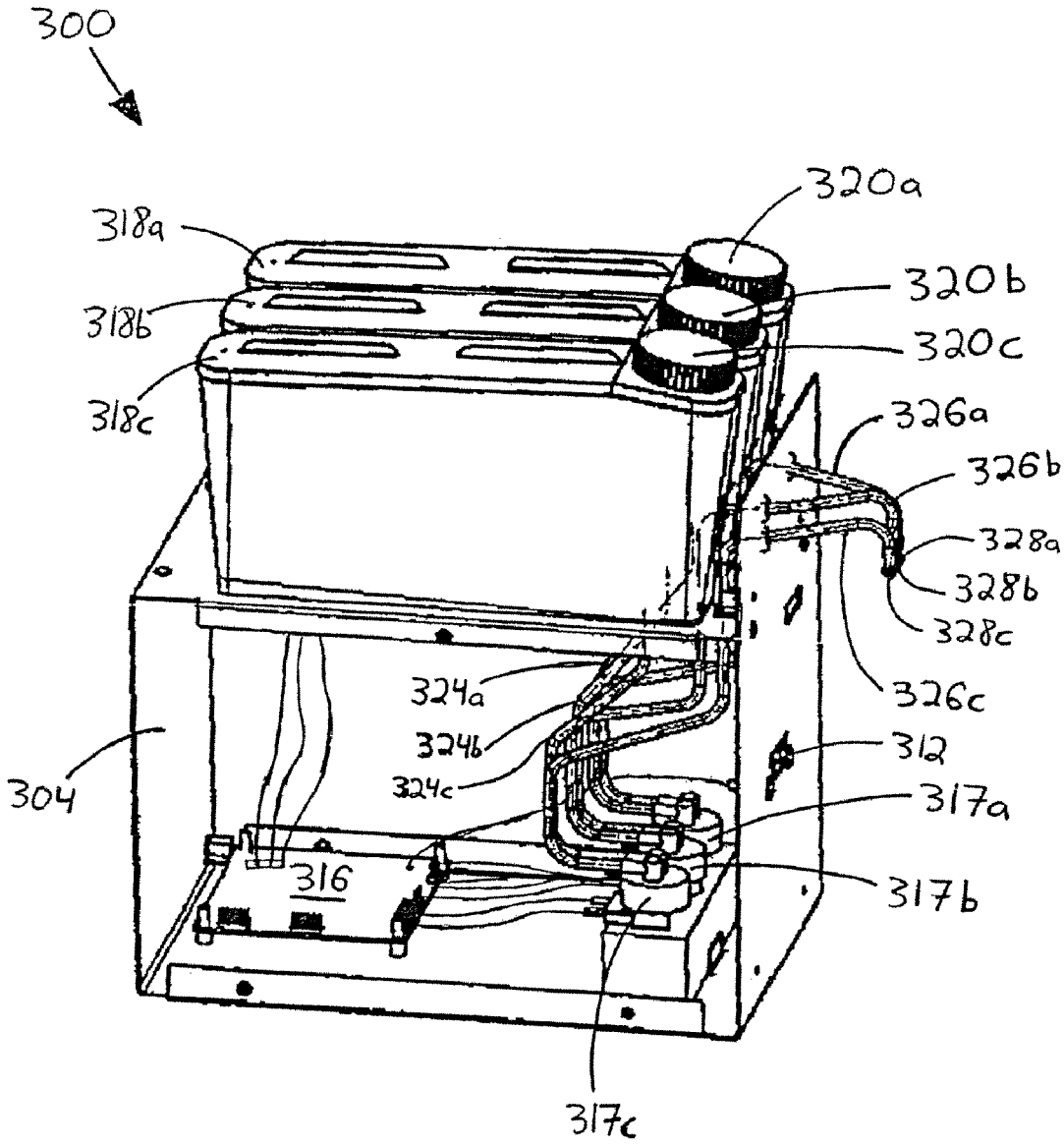
FIG. 9 is a side perspective view of the fluid dispensing system of FIG. 7 with portions of the outer housing removed.

With particular reference to FIG. 9, which is a side perspective view of the dispenser 300 with the front housing 302 and portions of the rear housing 304 removed, three reservoirs 318*a*, 318*b* and 318*c* for containing liquid flavoring are disposed in the rear housing 304, generally in an upper portion thereof to facilitate refilling. Each reservoir can contain a different type of flavoring. For example, the reservoir 318*a* could contain an "Irish Cream" flavoring, the reservoir 318*b* could contain a "French Vanilla" flavoring, and the reservoir 318*c* could contain a "Hazelnut" flavoring.

As can be seen best in FIG. 9, each reservoir has a corresponding dedicated pump connected only to that reservoir. In particular, the discrete volume pump 317*a* is connected to the reservoir 318*a* by connector tube 324*a*, the discrete volume pump 317*b* is connected to the reservoir 318*b* by connector tube 324*b*, and the discrete volume pump 317*c* is connected to the reservoir 318*c* by connector tube 324*c*. Similarly, the outlet of each discrete volume pump 317*a*, 317*b* and 317*c* is in fluid communication with its own dedicated connector tube 326*a*, 326*b* and 326*c*, respectively. Each connector tube 326*a*, 326*b* and 326*c* is in turn in fluid communication with its own, separate dispensing outlet 328*a*, 328*b* and 328*c*, respectively. The use of separate pumps, tubing, reservoirs and dispensing outlets prevents cross-contamination between flavors. The dispensing outlets 328*a*, 328*b* and 328*c* may be placed in close, side-by-side proximity to each other, so that a receptacle such as a coffee cup can be placed in the same position regardless of which reservoir 318*a*, 318*b*, or 318*c* is being sourced.

Figure 10:
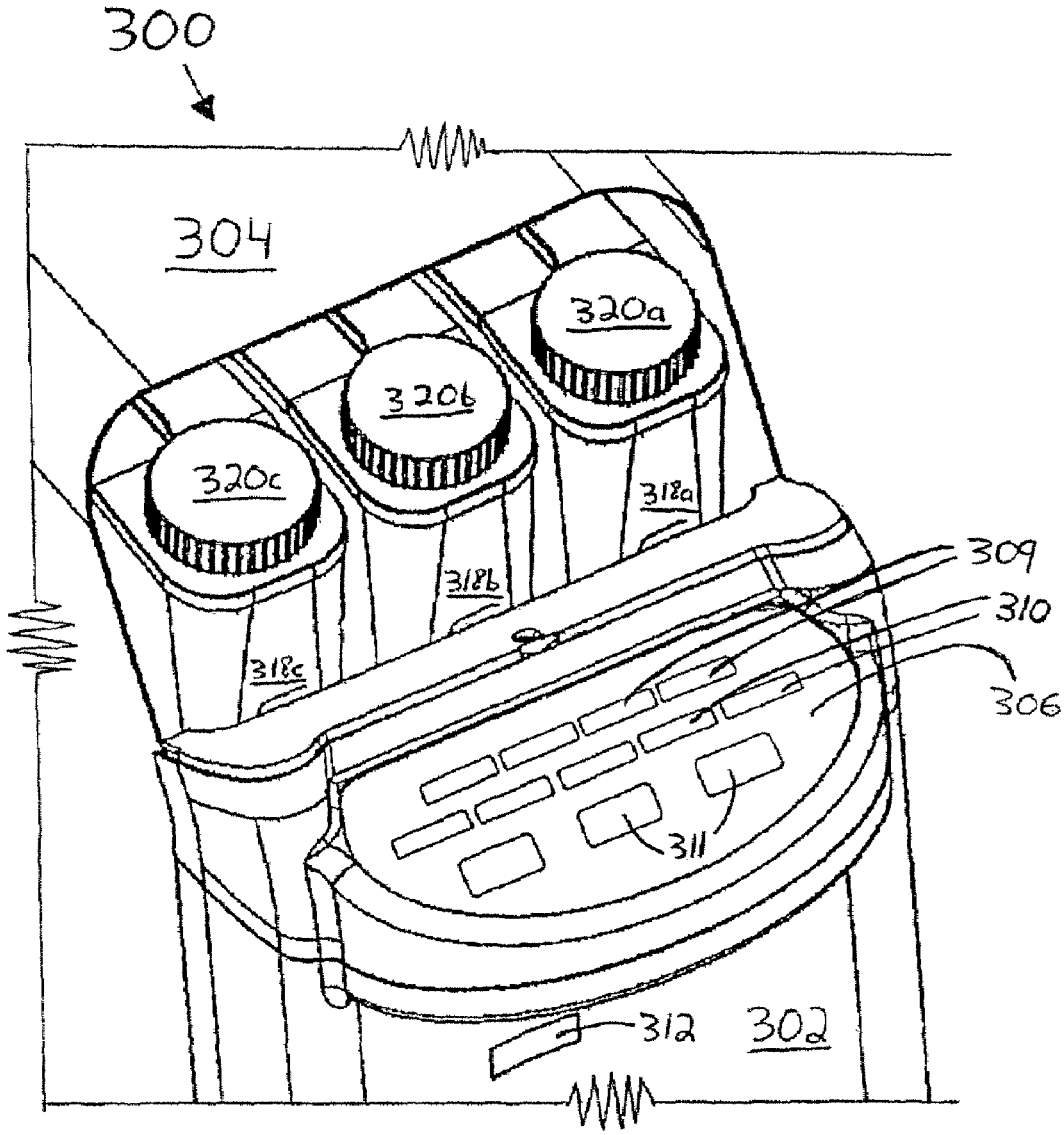
FIG. 10 is a front perspective view of a portion of the fluid dispensing system of FIG. 7 with the cover plate removed to expose internal reservoirs.

The reservoirs 318*a*, 318*b* and 318*c* are covered by a removable cover plate 319. A front perspective view of a portion of the dispenser 300 with the cover plate 319 removed is shown in FIG. 10. Each reservoir 318*a*, 318*b* and 318*c* has a removable sealing cap 320*a*, 320*b* and 320*c*, respectively, that can be removed when it is desired to add more liquid flavoring to a reservoir 318*a*, 318*b* and 318*c*, and then resealed to prevent evaporation or contamination of the liquid flavoring.

Now referring to FIG. 8, each reservoir may optionally be provided with a float switch 322*a*, 322*b* and 322*c* (only the float switch 322*b* is shown). A float switch 322*a*, 322*b* and 322*c* trips when the level of flavoring in its respective reservoir 318*a*, 318*b* or 318*c* falls below a certain level, and transmits a signal to the controller 316. Any suitable float switch may be used. Optionally, the float switches 322*a*, 322*b* and 322*c* may be omitted, and a non-electronic visual indicator of the level of liquid in the reservoir may be used instead.

Alternatively, particularly in a situation where it is desirable to use disposable reservoirs which do not include a float switch, one or more microphones may be provided adjacent to the pumps 317 (in FIG. 8, one microphone 323 is shown located adjacent to pump 317*b*) so that controller 316 can aurally detect when a reservoir is empty or almost empty. It will be understood that a pump may generate a different sound or noise when pumping air (or an air/fluid mix) as opposed to fluid. As such, the controller 316 can be programmed such that when one of the pumps 317 (for example, pump 317*a*) is operated, the controller 316 will monitor the microphone 323 to detect a change in some characteristic of the sound produced by the pump 317*a* (such as frequency, amplitude or the like) or some combination of these characteristics as compared to normal pump operation or as compared to an empty or almost empty pump operation. The microphone 323 and controller 316 may further include various signal processing systems or technology to improve detection of an empty reservoir. For example, the controller 316 may use signal filtering, matched filters, autocorrelation methods or the like for this purpose. In a particular embodiment, the controller 316 may also control the microphone 323 to detect the ambient noise in advance of operation of the pump 317*a* to determine if a reasonably accurate detection of the sound of the pump 317*a* is possible. In the case that the sound of the pump 317*a* cannot be detected well, the controller 316 may either prevent dispensing of fluid or allow a limited number of dispenses based on an amount of fluid typically available in one of the connecting tubes 326 until a detection of the sound of the pump is again possible.

Further, it can generally be beneficial to analyze the detected sound over a plurality of cycles of pump operation or over a plurality of operations of the dispenser to provide confirmation of the result before setting or indicating an alarm condition. In some embodiments, if the pump is operating at 60 Hz, several samples can be taken during the first several cycles to determine if the characteristics of the sound are outside of a predetermined range or match with a predetermined profile of the sound of empty pump operation. As indicated above, if there is some volume of fluid typically available in the connecting tubes, it is possible to detect the sound over a plurality of fluid dispenser operations before setting or indicating an alarm condition.

Still referring to FIG. 8, temperature sensors 330*a*, 330*b* and 330*c* (only the temperature sensor 330*b* is shown) may be positioned to measure the temperature of the liquid flavoring contained in each of the reservoirs 318*a*, 318*b* and 318*c*. One such suitable sensor is a thermister. Such sensors may be configured so that they do not contaminate the contents of the reservoirs 318*a*, 318*b* and 318*c*. Alternatively, a single temperature sensor (not shown) may be used to sense the temperature in the atmosphere surrounding the reservoirs 318*a*, 318*b* and 318*c*, as an approximation of the temperature of the liquid flavorings contained therein. For example, a thermister may be coupled to the controller 316 for sensing the temperature within the dispenser 300. The temperature information could then be correlated by the controller 316 with information regarding the density of the liquid flavoring at various temperatures to permit the controller 316 to modify the number of pulses to be sent to the relevant discrete volume pump 317*a*, 317*b* or 317*c*, depending on the calculated density of the liquid flavoring being dispensed. Alternatively, if feasible in the particular liquid flavoring dispenser 300, the density may be measured directly. Temperature information could also be used to correlate other factors affecting pump performance, such as viscosity. As temperature varies, possible changes in viscosity may be determined through a correlation and used to adjust the power supplied to the pump, thereby reducing the possibility of the pump stopping midway through a cycle due to undersupplying power, or overheating the pump due to oversupplying power.

Additionally, if different types of liquid flavoring are known to have different viscosity-temperature profiles, such data may be stored in controller memory and the controller 316 may be adapted to retrieve the relevant data indicative of the particular liquid flavoring contained in the particular reservoir 318*a*, 318*b* or 318*c*. This data may also be provided when different flavors require the use of different volumes of liquid flavoring to flavor the same drink. For example, the container in which the liquid flavorings are supplied may include a label having a numerical indicator which may be programmed into the controller 316 when the dispenser 300 is filled. For example, a manually adjustable potentiometer can be used as a means of providing this input to the controller 316 so as to access a stored data set representative of the characteristic of the associated flavoring liquid.

It is also envisioned to provide reservoirs 318*a*, 318*b* and 318*c* that are removable from the dispenser 300. In such a case, each removable reservoir 318*a*, 318*b* or 318*c* may be provided with a valve (not shown) for connecting to a mating valve (not shown) provided to connector tubes 324. For a removable reservoir 318*a*, 318*b* or 318*c*, indicator means may be provided that, when the reservoir 318*a*, 318*b* or 318*c* is installed, causes the controller 316 to access a stored data set corresponding to the characteristics of the fluid contained in the installed reservoir 318*a*, 318*b* or 318*c*. Such an indicator may comprise a mechanical tab for actuating a switch that transmits a signal to the controller 316, or a passive transponder, or any other suitable indicator. In the case that the reservoirs are removable, they may also be disposable or subject to recycling.

As noted above, the keypad 306 may include drink selection keys 309, size selection keys 310, and flavor selection buttons 311.

Examples of different types of drinks that might be flavored include coffee, cappuccino, latte and soda, among others. The additional input of the type of drink to be flavored can permit the controller 316 to make further modifications to the number of pulses to apply an appropriate dosage of liquid flavoring for the type of drink being flavored. For example, a different volume of liquid flavoring may be required to flavor a given size of cappuccino than to flavor a latte of the same size.

In general, the selection by a user of a particular flavor can be achieved by selection of the reservoir 318*a*, 318*b*, or 318*c* in which the desired liquid flavoring is contained. This selection process may be facilitated by using the display 307 to indicate the type of flavor contained within each reservoir 318*a*, 318*b* and 318*c*, or decals or other direct physical indicators may be placed in positions corresponding to the reservoir whose contents they describe. Pushing a flavor selection key 311 on the keypad 306 may transmit a signal to the controller 316, the signal containing information for the controller to determine the appropriate reservoir and pump combination.

For example, if a user wished to add "French Vanilla" flavoring to a large cappuccino, the user would press the drink selection key 309 corresponding to "cappuccino", the size selection key 310 corresponding to "large", and the flavor selection button 311 corresponding to the reservoir 418*b* (and hence to "French Vanilla"). As noted above, the correlation between the button corresponding to the reservoir 418*b* and the "French Vanilla" liquid flavoring contained therein could be achieved in any number of ways.

When pressed, each of the keys 309, 310 and 311 transmits a respective signal to the controller 316. The information contained in these signals permits the controller 316 to determine the selected reservoir and pump combination, as well as the appropriate number of pulses. As noted above, the controller 316 may also process other information, such as temperature or a direct measurement of viscosity, as well as other indicators representative of various other properties of the particular type of liquid flavoring contained in the reservoir 318.

In the example above, the controller 316 receives a signal from each of the depressed keys 309, 310 and 311, as well as any signals transmitted by the various sensors. The controller 316 then transmits the appropriate number of pulses for flavoring, for example, a large cappuccino with "French Vanilla", modified as dictated by received sensor signals, to the discrete volume pump 317*b*. The pulses drive the discrete volume pump 317*b* to operate over the appropriate number of cycles or sub-cycles and thereby pump an appropriate volume of liquid flavoring. As a result of the operation of the pump 317*b*, a quantity of liquid flavoring is dispensed by the pump 317*b* through the connector tube 326*b* and out of the dispensing outlet 328*b*. A corresponding amount of liquid flavoring is withdrawn from the reservoir 318*b* through the connector tube 324*b*. In the case of a simple reciprocating pump, dispensing occurs during each cycle, and in the case of an incrementally operable reciprocating pump, dispensing occurs after competition of a number of sub-cycles.

One skilled in the art will appreciate that a "flush" mode may be provided, in which a selected discrete volume pump 317*a*, 317*b* or 317*c* can be made to repeat its cycles continuously, and possibly at a high rate of speed, for a specific period of time. This "flush" cycle can be used to prime the selected pump 317*a*, 317*b* or 317*c* to remove air so that the liquid flavoring will be properly dispensed, or with water in the associated reservoir 318*a*, 318*b* or 318*c* to clean the pump before changing flavors. In general, pressing a certain combination of keys 309, 310, 311 may initiate the "flush" cycle.

One skilled in the art will further appreciate that the dispenser 300 may be configured so that the keypad 306 can be used to program or modify various settings of the controller 316.

SECOND EXAMPLE OF A LIQUID FLAVORING DISPENSER

Figure 11:
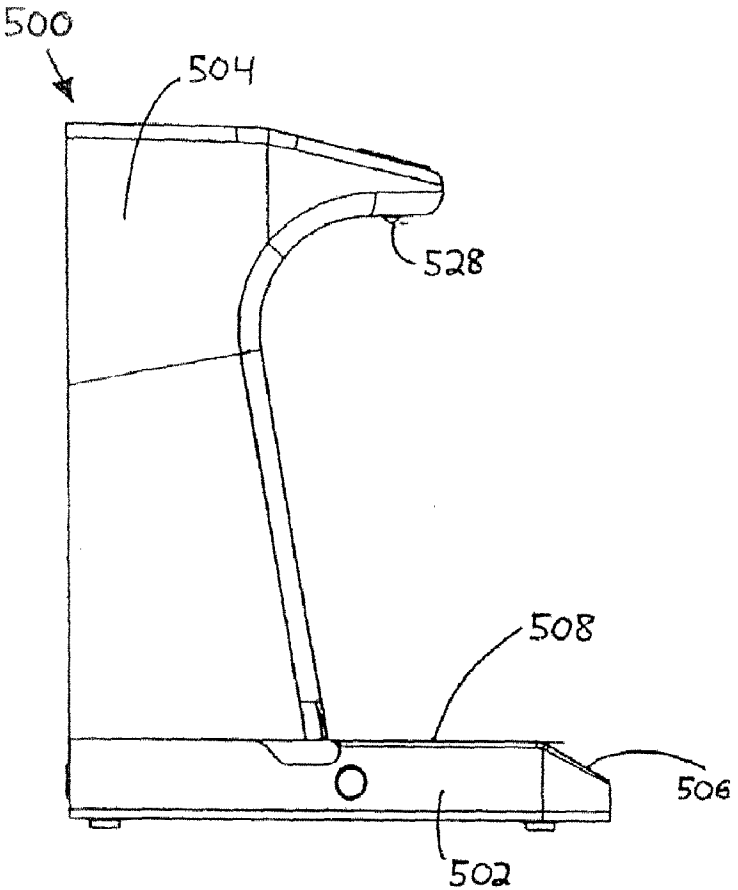
FIG. 11 is a side view of a fluid dispensing system according to another exemplary embodiment.

With reference now to FIGS. 11, 12, 13, 14 and 15, a second exemplary embodiment of a liquid flavoring dispenser 500 is shown. The liquid flavoring dispenser 500 is suitable not only for restaurant use, but also for use in a home or office environment. The liquid flavoring dispenser 500 comprises a bottom housing 502 and a top housing 504. The top housing 504 is removable from the bottom housing 502. FIG. 11 shows the liquid flavoring dispenser 500 with the top housing 504 removed. In general, the top housing 504 is pivotally mounted to the bottom housing 502 so that portions of the bottom housing 502 that are covered by the top housing 504 can be exposed by pivoting the top housing 504 forward relative to the bottom housing 502.

Figure 12:
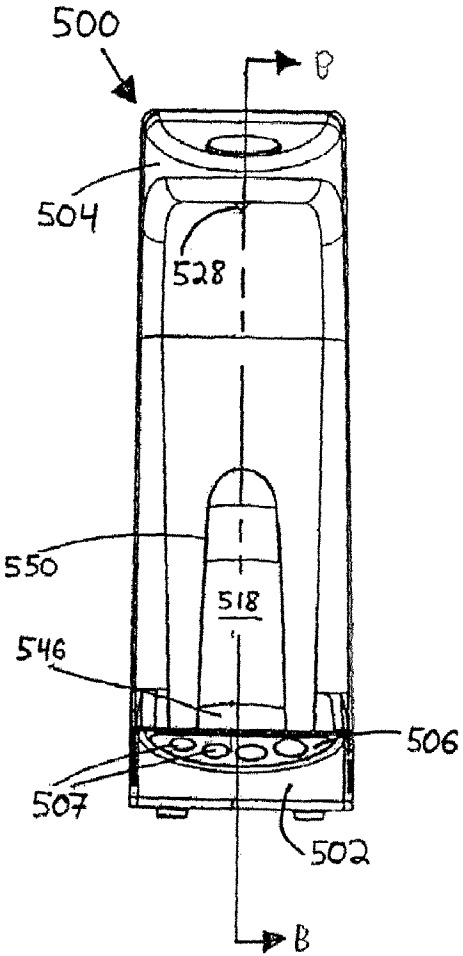
FIG. 12 is a front view of the fluid dispensing system of FIG. 11.

The liquid flavoring dispenser 500 may include a keypad 506 having a plurality of keys 507, and a cup support 508, both positioned on the bottom housing 502. As can be seen in FIG. 12, a controller 516 and a discrete volume pump 517 are generally disposed in the bottom housing 502. The controller 516 is operably coupled to the keypad 506 and to the discrete volume pump 517, as well as to a power source (not shown).

Figure 13:
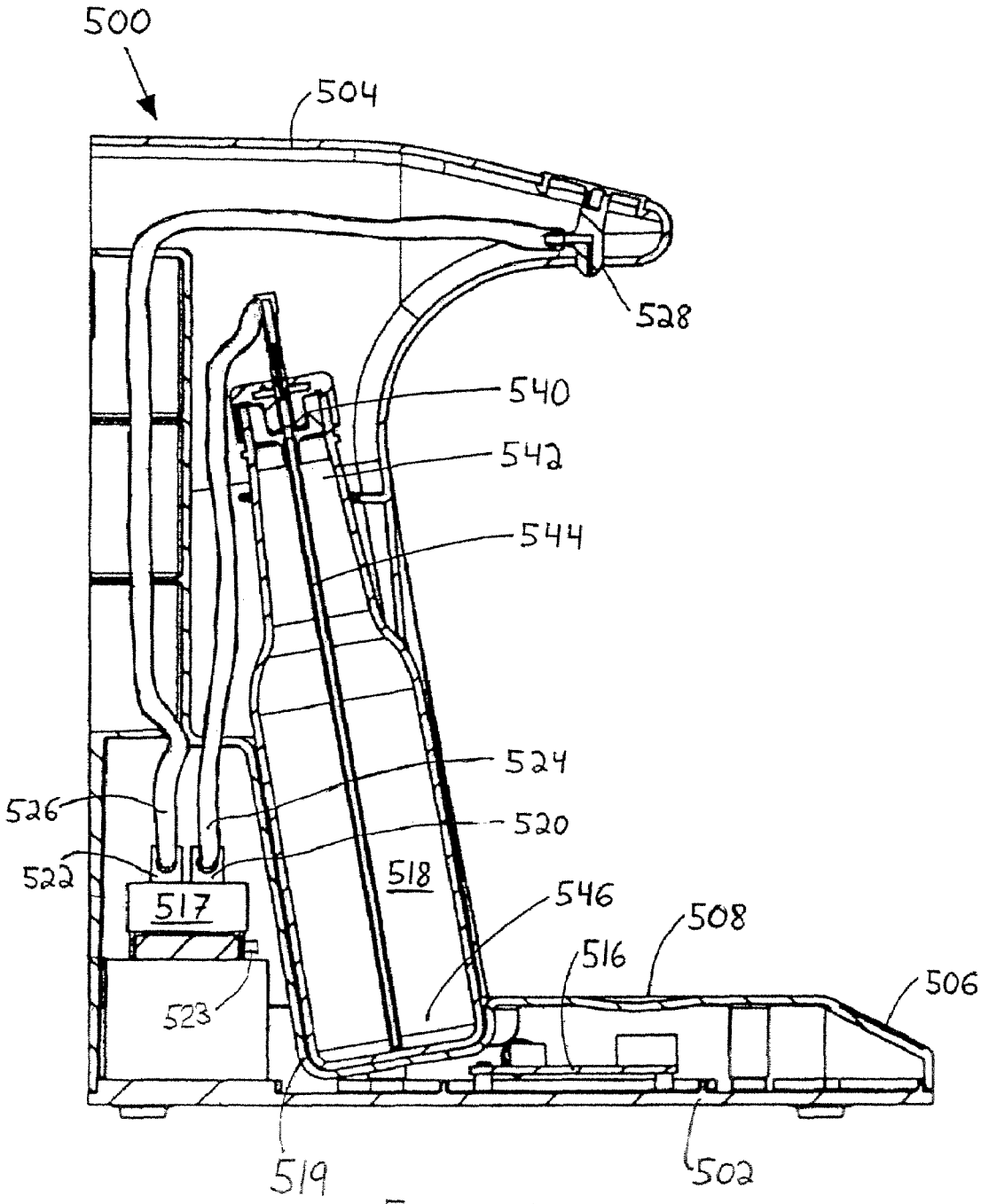
FIG. 13 is a cross sectional view of the fluid dispensing system of FIG. 11, taken along the line B-B in FIG. 12.
Figure 14:
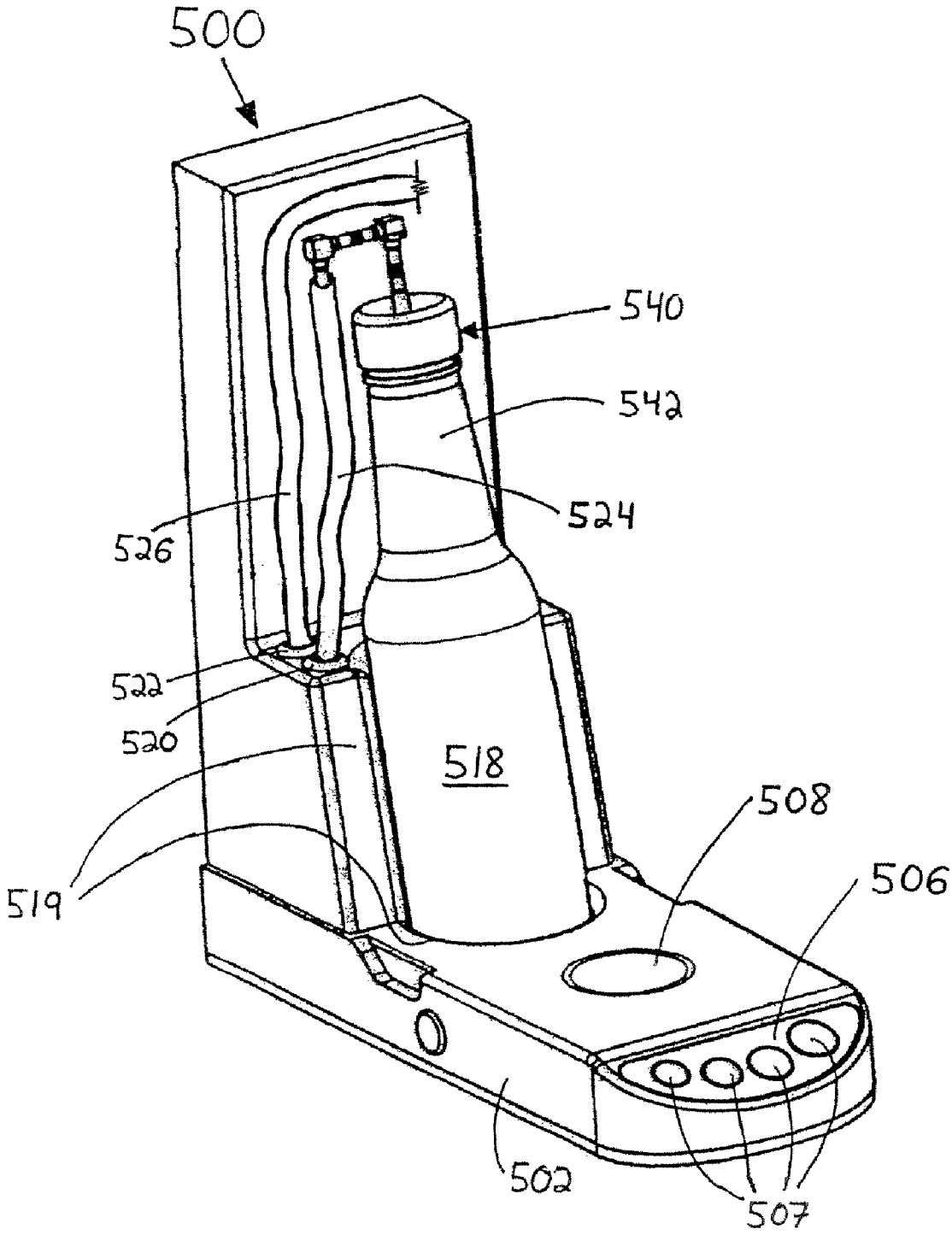
FIG. 14 is a front perspective view of the fluid dispensing system of FIG. 11 with the upper housing removed.
Figure 15:
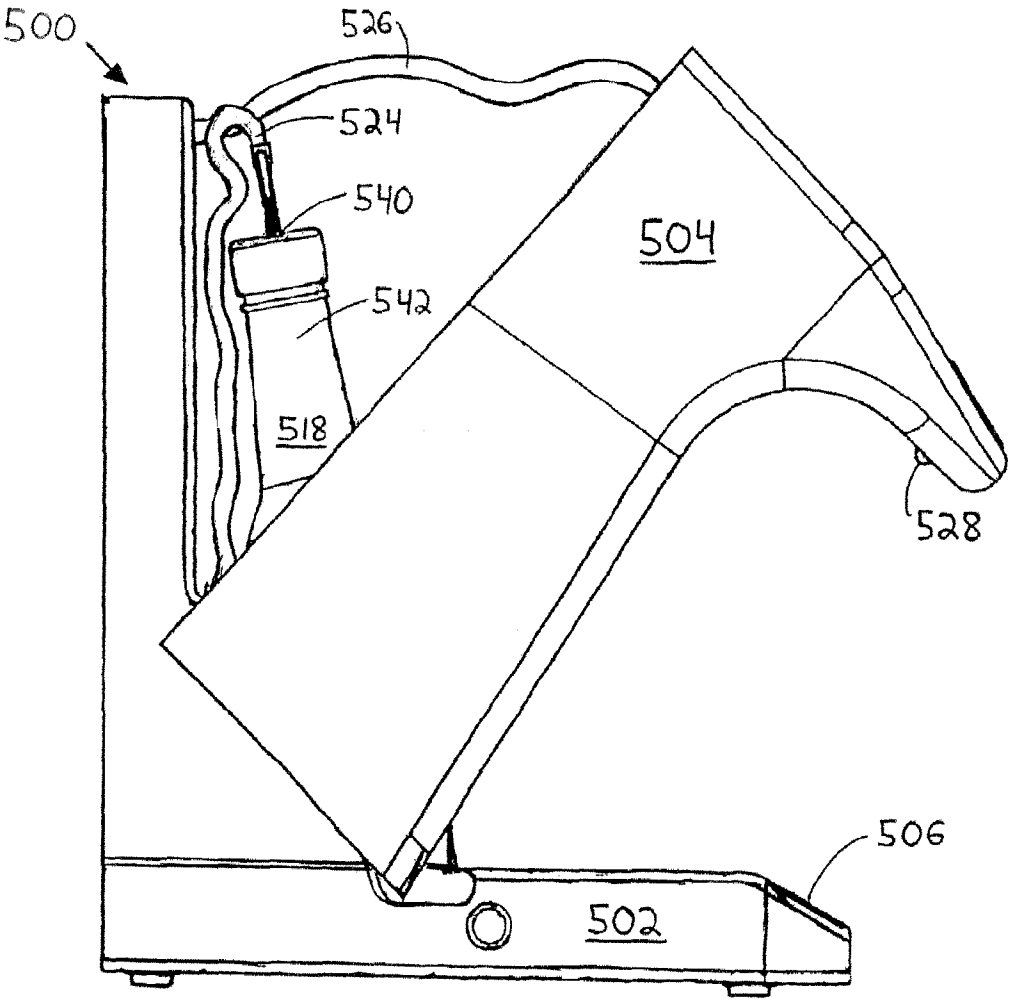
FIG. 15 is a side view of the fluid dispensing system of FIG. 11 with the upper housing pivoted forward.

As can be seen in FIGS. 13 and 14, a removable reservoir 518 in the form of a bottle 518 may be placed in the liquid flavoring dispenser 500. The bottle 518 may be disposable or may be recycled in some manner. As best seen in FIG. 14, the bottle 518 rests in a cradle 519 defined in the bottom housing 502 and may be covered by the top housing 504 during operation.

The discrete volume pump 517 includes a liquid inlet 520, and a liquid outlet 522. A first connector tube 524 is connected between the liquid inlet 520 and the bottle 518, and a second connector tube 526 is connected between the liquid outlet 522 and dispensing outlet 528. The dispensing outlet 528 is positioned over top of the cup support 508.

As best seen in FIG. 13, the bottle 518 has a special cap or insert 540 placed in its upper neck 542. The insert 540 has a full-length feed tube 544 extending to the bottom 546 of the bottle 518, and also has a small breathing aperture (not shown) defined therein. One end of the first connector tube 524 is couplable to the insert 540, and the other end of the first connector tube 524 is coupled to the liquid inlet 520 of the discrete volume pump 517, as described above. Thus, the discrete volume pump 517 may be in fluid communication with interior of the bottle 518 through the first connector tube 524.

In operation, assuming the discrete volume pump 517 has already been primed, a user would first place a cup (not shown) on the cup support 508 so that it is disposed beneath the dispensing outlet 528. The user would then press a button 507 on the keypad 506, the button 507 corresponding to the size of the cup. Pressing the button 507 transmits a signal to the controller 516, resulting in the controller 516 transmitting a discrete number of pulses to the discrete volume pump 517. The number of pulses transmitted by the controller 516 drives the discrete volume pump 517 to operate over a number of cycles or sub-cycles calculated to dispense the volume of liquid flavoring needed to flavor a beverage of the size selected by pressing the button 507. A corresponding volume of liquid flavoring is drawn out of the bottle 518 through the feed tube 544, with the volume of liquid withdrawn from the bottle 518 being replaced with air drawn in through the breathing aperture in the insert 540.

Referring to FIG. 12, it can be seen that the portion of the top housing 504 which covers the bottle 518 has a window 550 defined therein. The window 550 may comprise an aperture, or may comprise a piece of transparent material. If the label on the bottle 518 is appropriately sized so that the bottom portion 546 of the bottle 518 is uncovered, and the bottle 518 is made from a transparent material, the window 550 may permit a user to see when the bottle 518 is almost empty. In some embodiments, the liquid flavoring contained in the bottle 518 can be of a color that facilitates observation of the level of liquid contained in the bottle 518, without discoloring the beverage to which the flavor is added. The window 550 can also permit a user to observe a label on the bottle 518 so as to determine the type of flavoring that will be dispensed from the dispenser 500. Alternatively, as described above, a microphone 523 may be placed adjacent to the pump 517 so that the controller 516 can detect a change in the sound of the pump 517 in order to determine when the bottle 518 is empty or nearly empty and provide an alarm.

Once the supply of liquid flavoring contained in the bottle 518 has been depleted, the bottle 518 may be replaced as follows, with reference to FIG. 13. The top housing 504 is tilted forward relative to the bottom housing 502, as shown, to expose the bottle 518, and in particular the neck 542 and insert 540. The first connector tube 524 is then disengaged from the insert 540, and the bottle 518 may then be grasped by its neck 542, lifted out of the cradle 519 (not shown in FIG. 13) and removed from the liquid flavoring dispenser 500. A new bottle 518 of liquid flavoring may then be placed in the cradle 519 (not shown in FIG. 13), and the first connector tube 524 may be connected to the insert 540 in the new bottle. The upper housing may then be pivoted back to a closed position, as shown in FIG. 11, and the discrete volume pump 517 may then be primed so that the liquid flavor dispenser 500 is ready for use. If the bottle 518 is replaced before the liquid flavoring supply is completely exhausted, it is generally not necessary to prime the discrete volume pump 517. If the bottle 518 is replaced with a new bottle 518, for example, containing a different liquid flavoring, it may be appropriate to flush the discrete volume pump 519 before the new bottle 518 is installed.

If desired, the controller 516 may be provided with input means to indicate the particular flavor being dispensed, so that the controller can adjust the number of pulses, and hence the volume of liquid flavoring dispensed, on the basis of the known viscosity or other characteristics of a given liquid flavoring.

One skilled in the art will understand that many of the features and functions described above in respect of the liquid flavoring dispenser 300 may be incorporated, with appropriate modifications, into the liquid flavoring dispenser 500.

In addition, the liquid flavoring dispenser 500 may be adapted so that multiple dispensers 500 may be connected electrically and in parallel so as to be powered by a single power source (not shown).

It will also be appreciated that while a dispenser 300, 500 constructed in as described generally has a high degree of accuracy, it is inherent that some loss of liquid may occur within the tubing and connections. Nonetheless, with accurate calibration, it is possible to obtain appropriate accuracy for fluid dispensing according to aspects of the embodiments herein, combinations thereof, and the like.

One skilled in the art will further appreciate that it may be possible to adapt certain types of pumps that are not, in the strict sense, discrete volume pumps, in such a way as to render them useful in a liquid dispenser according to some embodiments. For example, it may be possible to adapt a peristaltic pump using a stepping motor so that its motion can be controlled to produce discrete pulses.

Description of a Controller

Referring back to FIG. 6, and as described above, in some implementations of fluid dispensing system 200, a controller 205 may be used to co-ordinate the operation of the elements of the fluid dispensing system 200. As noted earlier, the operation of the fluid dispensing system 200 includes control of the mechanical elements, dosage calibration, sensing functions relating to the fluid to be dispensed, user control and maintenance.

One skilled in the art will appreciate that a controller 205 suited for use in a fluid dispensing system 200 generally includes a suitable combination of hardware, software and firmware that is operably coupled to at least one of a number of sensors, pumps and other mechanical systems that make-up the fluid dispensing system 200. According to another exemplary embodiment, a controller 205 suited for use within a fluid dispensing system 200, may include a reprogrammable computer readable code means, memory (such as, RAM and EEPROM), input/output ports and a clock/timing circuit.

Also as noted above, in some implementations, the fluid dispensing system 200 includes a number of sensors. Each of the sensors may be connected to the controller 205 so that signals from the sensors can be processed and acted upon as required.

For example, the fluid dispensing system 200 can optionally include a cup sensor positioned to detect the presence or absence of a receptacle under the fluid dispensing outlet 208. If the cup sensor does not detect a receptacle under the fluid dispensing outlet the controller 205 may prevent dispensing of fluid. Alternatively, if a receptacle is detected, the controller 205 may permit dispensing of fluid. In some implementations, the cup sensor comprises an infrared sensor (e.g. the infrared sensor 312) positioned to detect the presence or absence of a receptacle under a fluid dispensing outlet (as described above). In related embodiments, dispensing of a fluid may occur automatically in response to the detection of a receptacle by the cup sensor. Further, also as described above, the cup sensor (e.g. cup sensor array 313) may detect the size of cup so that the controller 205 may control the dispensing accordingly. For example, the controller 205 may provide an alarm to request confirmation if a large dose of flavoring is selected for a medium cup or by automatically selecting a dosage size based on cup size. In a particular case, it may be possible to include a user override following an alarm if additional flavoring has been requested.

Fluid dispensing system 200 can also optionally include a means of establishing a wireless datalink. For example, a wireless datalink can be used to establish a connection with a handheld device (e.g. a Personal Digital Assistant or a notebook computer), so that fluid dispensing system 200 can be monitored for diagnostic reasons and/or re-programmed to update control features provided by the fluid dispensing system 200. One example implementation of the means for establishing the wireless datalink is an infrared sensor. Alternatively, the wireless datalink may be combined with the cup-sensor described above to make alternative use of the infrared sensor therein. For example, a BLUETOOTH™-based chip or communication system could be used to establish the wireless datalink. One skilled in the art will appreciate that any number of wired or wireless link protocols and systems may be used to establish a datalink as described.

The fluid dispensing system 200 may include sensors to measure the characteristics of a fluid to be dispensed. For example, a volume sensor can be used to generate a signal that reflects an indication of the volume of a fluid in the dispensing system 200 (e.g. the float switches 322*a*, 322*b* and 322*c*). The controller 205 can use this signal generated by the sensor to alert a user when the volume of the fluid in a reservoir should be refilled (e.g. by way of auditory or visual warning). Alternatively, there may be one or more small microphones (not shown) adjacent to the pumps to allow the controller 205 to detect a change in the sound of the pumps to indicate when the reservoir should be filled. This arrangement may be effective in order to reduce the overall cost of the fluid dispensing system 200 and particularly effective when the reservoirs are disposable.

Similarly, sensors can be used to measure characteristics such as, but not limited to, temperature, viscosity, acidity, carrier concentration, ion concentration, density, resistance and color. Such sensors can be used to enhance the functionality and operation of the fluid dispensing system 200. As described above, it will be understood by one skilled in the art that there will be occasions when a sensor used to detect one characteristic of the liquid flavoring may also indicate an additional characteristic. For example, if there is a known variation of viscosity in relation to temperature, it may be possible to utilize a measure of temperature to determine the approximate viscosity of the liquid flavoring. Similar relations may be utilized so that a measure of temperature may be used to determine an appropriate density of the liquid flavoring.

Sensor measurements can then be used to change the dosage calibration before or during the use of the fluid dispensing system 200. Such sensor measurement and calibration will be discussed in detail below with further reference to the pulse generator 202 and the controller 205 described above.

The fluid dispensing system 200 optionally includes a keypad (or keyboard) that provides a user with a means to interact with the fluid dispensing system 200 (e.g. keypads 306, 506). The keypad can be used to program, calibrate, maintain and/or use the fluid dispensing system 200 to dispense a fluid.

As discussed above, a pulse generator 202 may drive the operation of a discrete volume pump. In such a case, the controller 205 is generally programmed to control the pulse generator 202 to provide the correct number of pulses (i.e. the predetermined number of pulses) in response to a selection of a quantity and type of fluid desired by a user. In some embodiments, the controller 205 may adjust the number of pulses required for a standardized dosage of a particular fluid (e.g. a flavoring fluid) in response to various sensor measurements and/or information provided by a user. For example, a user may provide additional data to indicate the type of beverage being flavored, which may require an adjustment in the volume of fluid dispensed.

In one example implementation, pulses per dose are derived from an AC power source. A circuit is provided that derives a train of pulses corresponding to the zero crossings of the AC power signal. The circuit is further configured to provide a portion of the train of pulses to the mechanical means used to drive the pumps and other mechanical systems as described above. However, to reiterate, a particular dosage of a flavoring-fluid is dispensed by cycling a discrete volume pump a respective number of times to obtain the desired volume of flavoring, or in the case of an incrementally operable discrete volume pump, by driving the pump over a number of sub-cycles. As such, the continuously generated pulse train is generally not simply coupled to the mechanical systems used to drive the pumps. Accordingly, a switching means in the circuit is generally provided in combination with a control signal from the controller to activate the switching means; this can operate to limit the number of pulses sent to the mechanical systems used to drive the pump so that the correct volume/dosage of the flavoring fluid is dispensed.

When using a 60 Hz AC power source, the zero crossing of the signal corresponds to cycles of approximately 17 ms, that is an 8.5 ms cycle time to draw fluid into the pump, and an 8.5 ms cycle time to expel fluid from the pump. Accordingly, a pump operating from a signal based on an AC power source can generally only operate in discrete cycles of approximately 17 ms duration, or perhaps multiples thereof. This restriction on signal timing can reduce pump performance in terms of accuracy and efficiency. For example, the pump might not be designed to operate under such short cycle times if the physical pump cycle time is greater than 17 ms, or the pump may operate under shorter cycle times where most of the 17 ms cycle time is spent in idle.

Operating under such a narrow range of cycle times can mean that only a limited number of types of pumps may be used for a particular fluid dispensing apparatus. For example, more expensive piston pumps may be needed for a fluid dispensing apparatus, in comparison to less expensive diaphragm pumps.

A benefit of using an AC signal is that the pump can be directly connected to an AC power source with a limited amount of electronics necessary to drive the pump. However, if the system requires a piston pump, the cost of the piston pump may exceed the savings achieved from using less complex electronics.

Alternatively to embodiments using AC signal sources, the pulses per dose may be derived from a timing circuit, such as a 555-timer configured in a stable operation. The 555-timer is an integrated chip known in the art that can be configured to generate pulses from an electrical power source using a combination of resistors and capacitors. In some embodiments, the controller 205 may be a microcontroller that includes an internal timing circuit, instead of using an external timing circuit such as the 555-timer. Providing a microcontroller can also allow calibration as will be described in greater detail below. Generally, calibration data, which may include pulse duration/width amplitude and frequency, can be stored in a non-volatile memory portion of the microcontroller so that the calibration data may be retrieved upon activation of the fluid dispensing system.

In either example described above, a continuous train of pulses can be generated directly from a timing circuit, instead of being derived from an AC power source as described in previous examples. Deriving the pulses per dose from a timing circuit permits the use of a DC power source, such as an electrochemical battery, solar cell or the like, since the zero crossing from the AC power source is not being used to generate the pulses. Furthermore, deriving the pulses from a timing circuit allows modification of the signal frequency, unlike AC signal sources, which generally have a fixed period between pulses of approximately 17 ms. Since coupling a timing circuit with a DC power source can allow a wider range of potential cycle timings in comparison to an AC power source system, it may be possible to use a wider range of pumps with a system employing a timing circuit and a DC power source.

Figure 16:
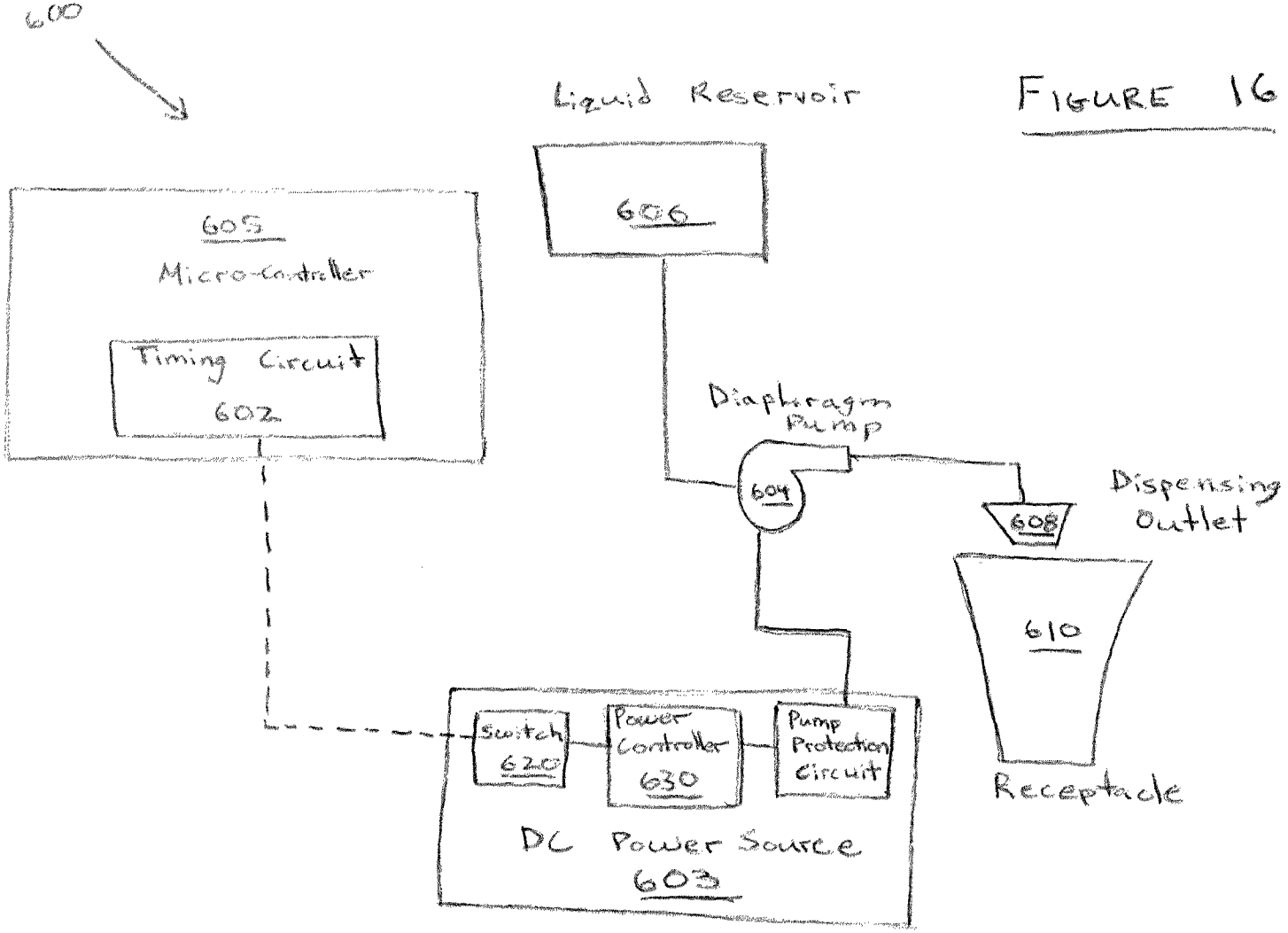
FIG. 16 is a schematic diagram of a fluid dispensing system according to another exemplary embodiment including a timing circuit, a micro-controller, a diaphragm pump, and a DC power source.

Referring to FIG. 16, illustrated therein is a schematic diagram of elements of a fluid dispensing system 600 according to another exemplary embodiment.

Fluid dispensing system 600 includes a timing circuit 602, a DC power source 603, a diaphragm pump 604 and a microcontroller 605. In this embodiment, the timing circuit 602 is included in the microcontroller 605, however, the timing circuit 602 may also be a separate element. The microcontroller 605 and timing circuit 602 are in communication with the DC power source 603 (this communication shown as a dashed line). The DC power source 603 is coupled to the diaphragm pump 604 in order to transmit power thereto. With this arrangement, microcontroller 605 controls timing circuit 602 to generate and send timing signals/pulses to DC power source 603, which then sends power to diaphragm pump 604 to drive diaphragm pump 604 over a predetermined number of pump-cycles. In this embodiment, the pulses from the timing circuit 602 trigger a switch 620, such as a transistor or relay, which causes DC power source 603 to provide power to diaphragm pump 604. The switch 620 is controlled by the microcontroller 605 and timing circuit 602 to drive the diaphragm pump 604 over a predetermined number of pump-cycles. The predetermined number of pump-cycles corresponds to a predetermined discrete volume of fluid that is to be pumped from liquid reservoir 606 to dispensing outlet 608, where it is received in a receptacle 610.

In this way, microcontroller 605 can control the timing circuit 602 and switch 620 to control each cycle of diaphragm pump 604 to dispense a discrete volume of fluid based on various factors, including, for example, selection of quantity and type of fluid inputted to microcontroller 605 by a user. Accordingly, microcontroller 605 may have a plurality of inputs and outputs to determine the particular type of fluid and quantity to be dispensed. For example, the inputs of the microcontroller may be connected to a keypad or similar input means to allow the user to make a selection of a particular type and quantity of fluid to be dispensed. The inputs may also be connected to a plurality of sensors for determining: the temperature of the fluid, the viscosity of the fluid, whether a receptacle is under the dispensing outlet, or other variables pertaining to the fluid dispensing apparatus. The outputs of microcontroller 605 may be connected to one or more timing circuits 602, with respective DC power sources 603, diaphragm pumps 604 and fluid reservoirs 606, for dispensing a particular type of fluid irrespective of other types of fluids. This can be particularly beneficial when dispensing, for example, different coffee flavorings where it is undesirable to mix different flavorings by dispensing more than one flavor using a single pump.

As previously described, pulses can be generated by timing circuit 602. In the instant embodiment, these pulses may have a square waveform, including, for example, low and high portions corresponding to periods when the pump is triggered to draw in and expel fluid respectively. For example, in the instant embodiment, diaphragm pump 604 is configured to draw in fluid upon generation of a high signal, which corresponds to a provision of power from DC power source 603. Upon the generation of a low signal, power is turned off and diaphragm pump 604 returns to a rest position corresponding to the expulsion of fluid. Although square waves have been suggested, other embodiments may use alternative waveforms, for example triangular waves, or square waves with reversed operation with respect to high/low signal portions and expel/draw sub-cycles, or square wave of opposite polarity during expel/draw sub-cycles. Alternate configurations may require alternate discrete volume pumps.

By interacting with the switch 620, microcontroller 605 and timing circuit 602 can control the amplitude, duration, and frequency of pulses of power sent to diaphragm pump 604 from power source 603, all of which can contribute to the accuracy of the diaphragm pump 604 when dispensing a predetermined volume of fluid. For example, the frequency of pulses can affect whether or not each pump cycle completes prior to the execution of a subsequent pump cycle. If the frequency is too high, only a portion of a pump cycle may be completed resulting in dispensing only a portion of the discrete volume of fluid, ultimately resulting in lower accuracy of the fluid dispensing system 600. Using the microcontroller 605 and the timing circuit 602, the frequency or duration of pulses may be controlled to avoid incomplete pump cycles.

In another example of a control of the diaphragm pump 604, the expulsion stroke of the pump may be longer than the intake stroke or vice versa. In such cases, the high and low portions of the pulse from the timing circuit 602 may be adjusted to be an appropriate duration respective to stroke duration. That is, timing circuit 602 may adjust the duration of high and low portions of the pulses to correspond with the specific durations of the expulsion and intake strokes of the particular diaphragm pump 604. The ability to adjust and configure the timing circuit 602 with the microcontroller 605 is intended to prevent problems of incorrect intake or expulsion, as well as potential overheating as in the case of prolonged activation of the diaphragm pump 604.

As a further example, the power requirements of the diaphragm pump 604 may change, for example, due to a fluid having different characteristics such as a greater viscosity. For example, if the viscosity is higher than the current calibration point set for the particular pump, the pump may not complete a full pump cycle, resulting in dispensing only a portion of the discrete volume of fluid. Accordingly, microcontroller 605 may communicate with the switch 620, for example, by having timing circuit 620 change the amplitude of the pulses, to control the DC power source 603 to change in the required provision of power to actuate the pump for the particular fluid to be dispensed. In particular, the amplitude of the pulse from the timing circuit 602 may signal switching means 620 to allow the provision of more or less power from DC power source 603 in order to allow diaphragm pump 604 to dispense the particular fluid based on adjusted power requirements. In such cases, the amplitude of the power may be controlled using, for example, a transistor or a variable resistor.

In the examples described above, microcontroller 605 can initiate a command to change the amplitude, frequency, or duration of the pulses that are generated by the timing circuit 602 to control the provision of power to pump 604. Such commands from microcontroller 605 may be issued responsive to, for example, sensory inputs, or user inputs.

In this embodiment, diaphragm pump 604 may be similar to the diaphragm pump 10, described previously, in which a fluid inlet will be in fluid communication with a liquid reservoir 606, and a fluid outlet will be in fluid communication with a dispensing outlet 608. In some embodiments, the liquid reservoir 606 may be easily removable from fluid dispensing system 600, as described in previous embodiments. For simplicity, the remainder of the fluid dispensing apparatus 600 will be described with reference to components of the diaphragm pump 10, as shown in FIGS. 1*a* and 1*b*.

As described above, pulses from timing circuit 602 activate switching means 620 to control the provision of power to pump 604. Each provision of power can energize a solenoid (not shown), which moves shaft 24 of diaphragm pump 604 in order to draw fluid into pump 604 through the fluid inlet. Conversely, turning off the power may de-energize the solenoid and a return mechanism (not shown) may cause the pump to return to a rest position and expel fluid from pump 604 through the fluid inlet. Shaft 24 may also be driven by, for example, an induction coil, an electric motor, pneumatics, or the like. Similarly, the return mechanism (not shown) may be, for example, a spring, induction coil, pneumatics, or the like.

DC power source 603 can be any form as previously described, such as, a battery or a solar cell, or as in the instant embodiment, the DC power source may be a converted AC-DC power source having a 24 VAC supply that is rectified to a 34 VDC supply using a bridge rectifier as known in the art. The 24 VAC supply generally has a sinusoidal waveform with a 60 Hz frequency and a root-mean-square (RMS) voltage of 24V, however different waveforms, frequencies and voltages may be used. If using a higher voltage AC source, such as household electrical socket with 120 VAC, a transformer may be used to convert the voltage to an appropriate value. Under some conditions, the RMS voltage of the AC source may fluctuate from the nominal value of 24V. For example, fluctuations in the order of 10-20% may occur as a result of other loads drawing power from the AC source. In order to smooth out such power fluctuations, a capacitor can be used in parallel with the rectified 34 VDC supply, or a portion thereof. For example, an 1800 uf capacitor in parallel with the 34 VDC supply is suitable for smoothing power fluctuations in the instant embodiment. In some cases, power fluctuations may also occur in the form of fluctuating current, or combinations of voltage and current and other dampeners may be implemented to attenuate such fluctuations.

Figure 17:
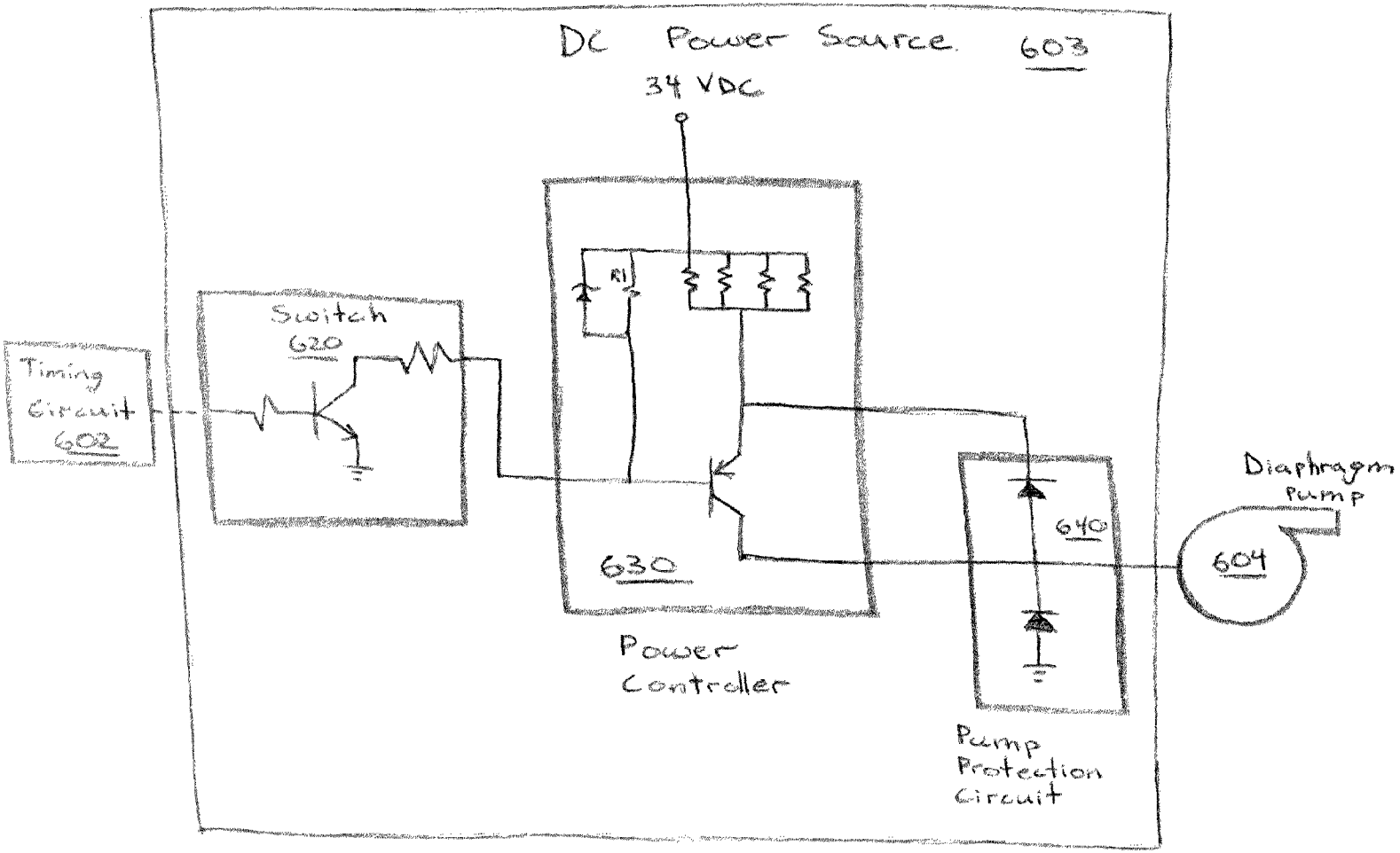
FIG. 17 is a schematic diagram of an exemplary circuit for the DC power source shown in FIG. 16.

Referring to FIG. 17, illustrated therein is a schematic diagram of an exemplary embodiment of a DC power source 603. The particular electrical elements shown in FIG. 17 are for exemplary purposes and other similar electrical elements or circuits may be used in place of those depicted. In general, DC power source 603 includes a switch 620 that receives pulses from timing circuit 602. Each pulse triggers switch 620 to provide power (for example, allowing the flow of electrical current) from DC power source 603 to diaphragm pump 604. A power controller 630 can be included inline within DC power source 603 to reduce power fluctuations that may affect pump performance and accuracy. A pump protection circuit 640 can also be provided inline within DC power source 603 to reduce the chance of electrical spikes damaging diaphragm pump 604 when alternately turning the pump on and off. It will be understood that the elements of DC power source 603 may alternatively be provided as separate components of the system 600 or in other configurations as are known by those of skill in the art.

As shown, pulses from timing circuit 602 are generally transmitted to DC power source 603, which correspondingly provides power to diaphragm pump 604. In this embodiment, pulses from timing circuit 602 are transmitted to switch 620, which may be, for example a semi-conductor switch such as a transistor, or the like. When the signal or pulse from timing circuit 602 indicates the diaphragm pump 604 should be powered, the switch 620 closes and allows current to flow from DC power source 603 to diaphragm pump 604. In some embodiments, the use of a transistor may be advantageous because of the generally fast operational response times of transistors in comparison to other types of switches. Fast operational response can allow faster switching of the diaphragm pump 604 between on and off conditions, which can also provide greater volume dispensing accuracy. Furthermore a transistor's ability to allow all, a portion, or none of the power from DC power source 603 to flow to diaphragm pump 604 can be advantageous when attempting to control the amplitude of the provision of power based on changing power requirements, for example, as in the case of changing viscosity. In alternative embodiments, other types of switches, or the like, may be used instead of a transistor.

Power controller 630 serves to attenuate variations in power from the DC power source 603 that may occur for a variety of reasons. As previously described, power required by the pump 604 may vary as a result of changing fluid viscosity. In addition, wear on the pump can also have an effect on power required over time. There may also be variations in the power available from the DC power source, such as line spikes and dips. These types of power fluctuations can affect pump performance with respect to efficiency and accuracy. For example, power dips when pumping high viscosity fluids can lead to inaccurate fluid dispensing due to incomplete pump cycles where only a fraction of the amount of fluid to be dispensed is processed by the pump. In the case of lower viscosity fluids and power spikes, the pump may overheat if too much power is sent to the pump. As such, power controller 630, may include, for example, a constant voltage controller or a constant current controller to attenuate variations in power, which may improve pump performance.

Referring to the exemplary embodiment of FIG. 17, power controller 630 is shown as a constant current controller including a resistor bank, a PNP transistor, and a zener diode in parallel with a resistor (the constant current controller and components thereof are shown symbolically). Placing the zener diode in parallel with the resistor sets up a constant current and voltage applied to the base of the PNP transistor, thereby keeping the transistor in the off state and restricting the flow of power from DC power source 603 to diaphragm pump 604. When switch 620 closes in accordance with a pulse from timing circuit 602, the switch 620 diverts current away from the base of the PNP transistor, thereby allowing current to flow through the collector and emitter of the PNP transistor to provide power to diaphragm pump 604. Because the voltage across the zener diode is constant (and the voltage drop across the transistor is generally negligible) the voltage drop across the resistor bank is approximately constant and equal to the voltage drop across the zener diode. With a constant voltage drop across the resistor bank, the current through the resistor bank also remains constant. The current through the resistor bank is also approximately equal to the current sent to the diaphragm pump 604 (assuming a negligible current passes through the base of the PNP transistor). Accordingly, power fluctuations in the form of current can be smoothed out using the constant current controller, resulting in better control of the power supplied to diaphragm pump 604. Particularly, implementing the constant current circuit described above can help reduce the problem of oversupplying power to the pump 604, which may cause overheating of the pump. With regard to the potential problem of undersupplying power to the pump, a capacitor (not shown) can be added in parallel with the power controller 630 or DC power supply 603. The capacitor can serve as a buffer, for example, when power draw on the system exceeds supply, or when the power supply experiences power dips. Furthermore, power controller 630 may be configured to adjust the amplitude of the provision of power to diaphragm pump 604. For example, the resistor bank may include a variable resistor such that the current sent to diaphragm pump 604 is adjustable. Furthermore, the PNP transistor and related circuitry may be configured to allow all, a portion, or none of the current to flow based on the amplitude of the pulse from timing circuit 602. In other embodiments, power controller 630 may be constructed using alternative techniques with other circuits, components and configurations thereof. For example, power controller 630 may be a different type of constant current controller, or power controller 630 may be a constant voltage controller.

As shown in the instant embodiment, the DC power source 603 also includes a pump protection circuit 640 that can reduce the risk of power spikes when the pump 604 is alternately turned on and off. Because diaphragm pumps typically include an induction coil (i.e. in the form of a solenoid driver), when power to the pump 604 is quickly turned on and off, the induction coil may induce a flow of current, even after the circuit has been broken. This induced flow of current may lead to a high voltage spike that could damage the pump, or other portions of the fluid dispensing system. By implementing a protection circuit 640, such as the one shown including two diodes, induced current from the induction coil circulates and dissipates even after the pump 604 has been turned off. However, no current is intended to flow through the diodes while power is applied to the pump 604. In general, providing the pump protection circuit 640 reduces the chance of voltage spikes, thereby reducing potential damage and overheating of the diaphragm pump 604.

Another problem mentioned briefly above, is that diaphragm pump 604 may not complete each discrete cycle if the pulses from timing circuit 602 are too short. In such cases it may be desirable to extend the duration of the pulses, or high and low portions thereof, to improve the ability of the pump to complete each discrete cycle as intended. Accordingly, it may be desirable to configure timing circuit 602 such that the high and low portions of the pulses have durations which exceed the duration required to complete the intake and expulsion strokes of the pump cycle respectively. For example, it may take 40 ms to draw fluid into diaphragm pump 604, and 50 ms to expel fluid from diaphragm pump 604, resulting in a pump cycle having a period of 90 ms. In this case, timing circuit 602 may be configured to apply a high signal for 50 ms and a low signal for 60 ms corresponding with the intake and expulsion strokes respectively. Accordingly, the actual period of the pump cycle is extended to 110 ms in an attempt to improve the ability of the pump to fully complete each intended pump cycle in order to dispense the predetermined volume of fluid. Extending portions of the pulse beyond the time required for pump 604 to complete respective portions of a cycle can help account for possible variations in pump performance that may occur, for example, from changing fluid viscosity or fluctuations in the power supply. For example, it is anticipated that extending the high portion of the pulse allows a longer provision of power from DC power source 603, which can allow more work to be done by the pump on the fluid in order to improve the probability of completely drawing fluid into the pump. Such an increase in work may be necessary in order to pump higher viscosity fluids that may experience more hydrodynamic friction, which can demand more power as compared to lower viscosity fluids. Correspondingly, extending the low portion of the pulse is anticipated to allow the return mechanism (i.e. a spring) to provide a force for a longer period and allow complete expulsion of the fluid in the pump. In the instant embodiment, the extension of the intake and expulsion strokes is generally appropriate so that each pump cycle is completed fully with respect to intake and expulsion such that the discrete volume of fluid may be dispensed in a reliable fashion.

In order to avoid some of the potential problems described above, fluid dispensing system 600 incorporates the timing circuit 602 and the power controller 630. Problems in fluid dispensing regarding power fluctuations, short pulses, and temperature changes of the fluid may result in dispensing volumes of fluid that deviate from the predetermined volume of fluid. More particularly, a system including an AC power source may experience fluctuations in the AC line voltage on the order of 10-20% that can hinder the ability of a diaphragm pump to operate in complete cycles. In addition, pulses derived from an AC power source may be too short in comparison to the time necessary to complete full pump cycles. Furthermore, these short pulses may lead to pump cycles where the intake and expulsion stroke coincide momentarily thereby introducing transient fluid dynamics within the pump. Such transient effects can interfere with the predetermined volume of fluid to be dispensed, in addition to inaccuracies associated with incomplete cycling of the pump. Deviations in dispensing may also result from changing fluid properties. For example, as fluid temperature changes (e.g. due to overheating of the pump), the density and viscosity of the fluid may change, resulting in an undesirable change to the dosage of flavoring dispensed.

The fluid dispensing system 600 described above is anticipated to improve the accuracy of the amount of fluid dispensed as compared to other fluid dispensing systems for liquid flavorings and as compared to a fluid dispensing system providing power from a standard AC power source based on a 60 Hz waveform. Accuracy improvements are expected to be maintained even if the DC power source 603 experiences line fluctuations from the AC power source. In some cases, the operating temperature of the pump 604 may also be reduced.

Figure 18:
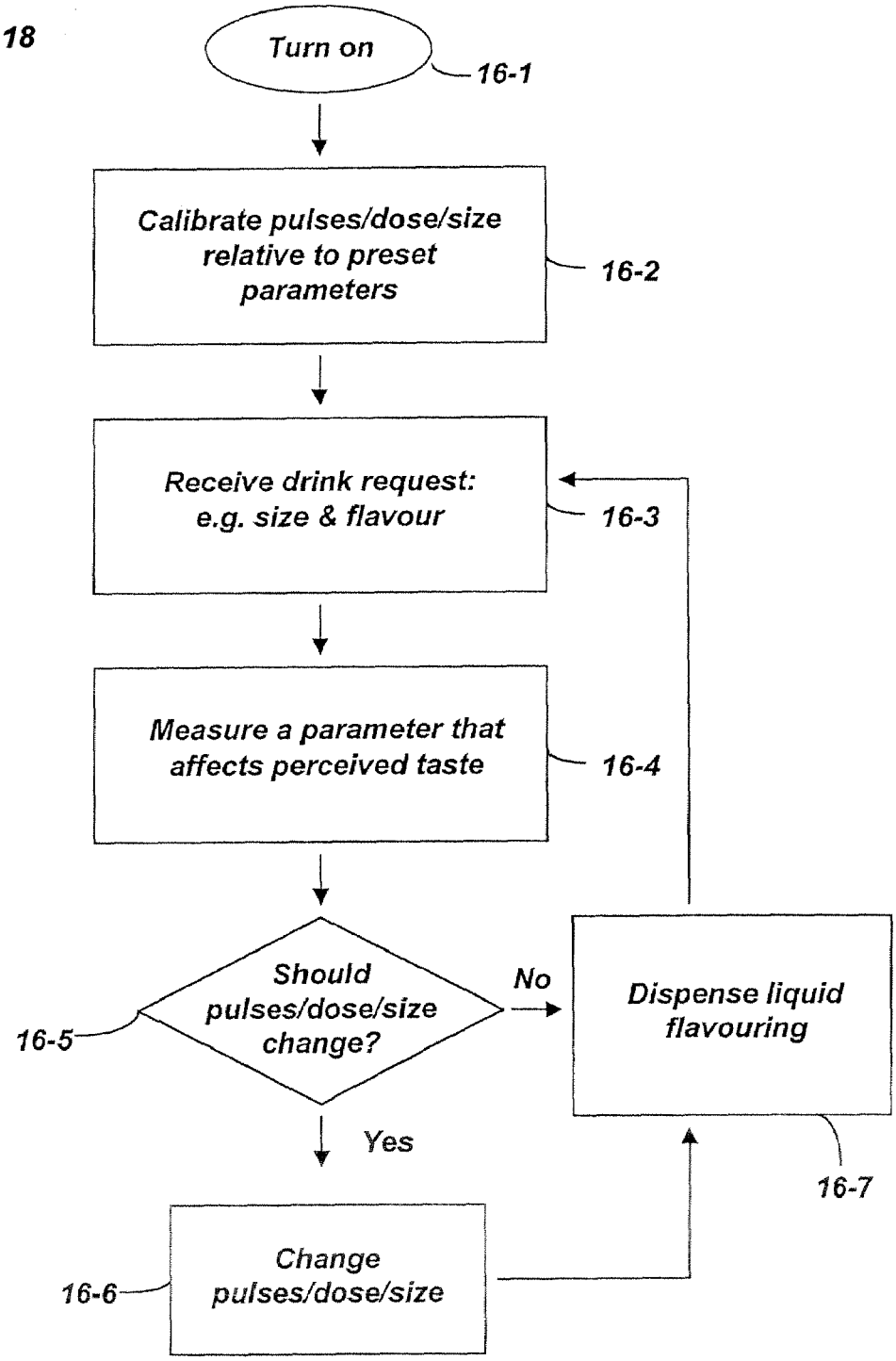
FIG. 18 is a flow chart showing an example of the operation of a fluid dispensing system.
Figure 19:
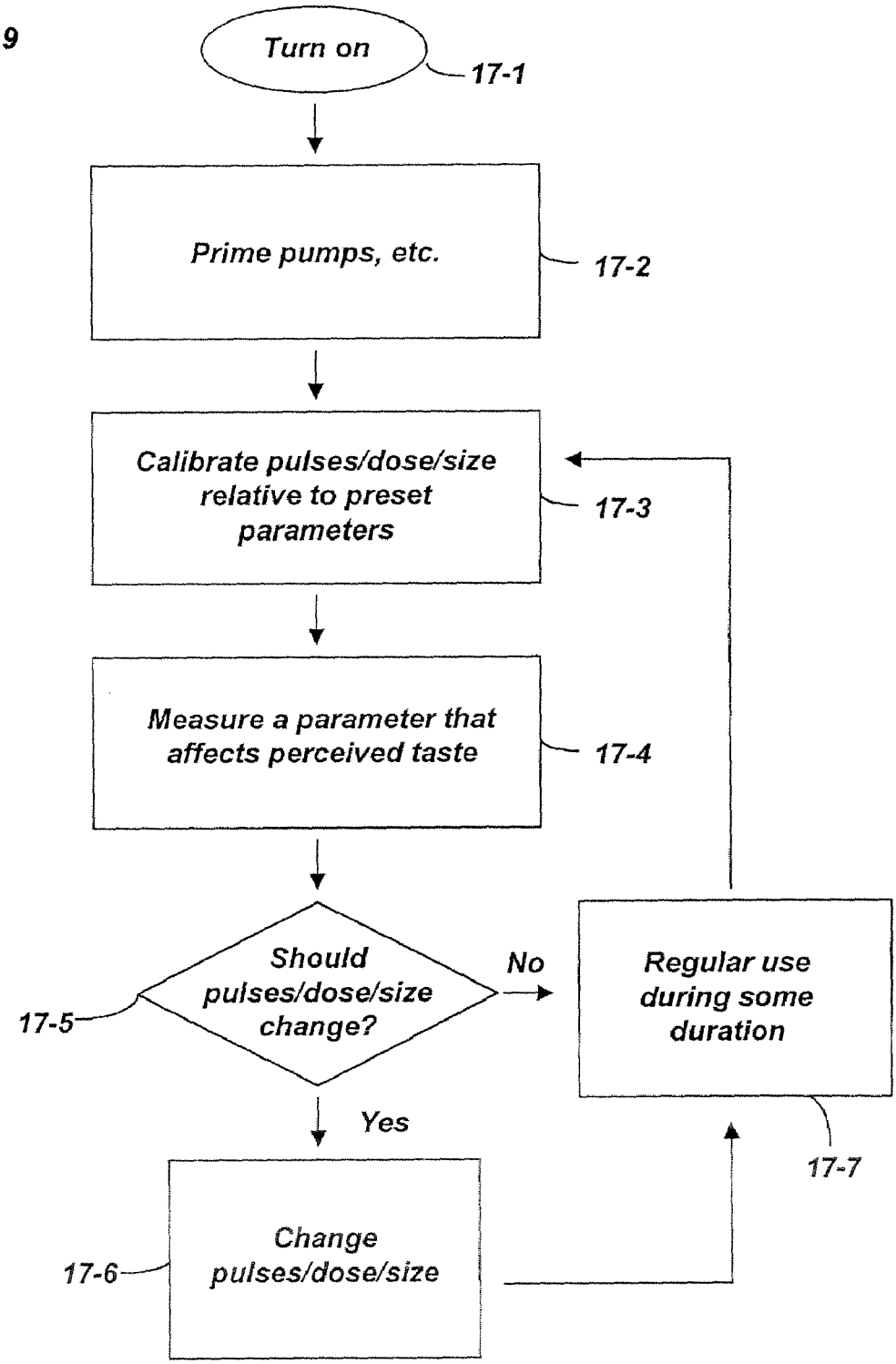
FIG. 19 is a flow chart showing another example of the operation of a fluid dispensing system.

Reference is now made to FIGS. 18 and 19. As discussed previously, dosage calibration can be carried out in response to measurements of the fluid. According to some embodiments, a means for calibrating, for example, a fluid dispensing system 200 may be provided. The means for calibrating may be applied to other fluid dispensing systems, such as those disclosed herein.

As noted above, small amounts of flavoring can have a significant effect on the perceived taste of a beverage, so it is beneficial to control the actual amount of pure flavoring compounds added to a beverage. Calibration is a desirable feature in some embodiments because the concentration of pure flavoring compounds in a volume of favoring fluid can change over time and/or in relation to environmental conditions. For example, the flavoring fluid becomes noticeably more concentrated if a significant amount of the carrier evaporates relative to the pure flavoring compounds. As another example, the amount of pure flavoring compounds provided per pulse can change as a function of temperature. As an example, temperature can affect the viscosity of the fluid and if the temperature increases, more fluid per pulse may flow as a result and vice versa. Similarly temperature can affect density. Consequently, depending on the temperature, the amount of pure flavoring compounds provided can change independently of the selection of the dosage by a user.

Accordingly, the controller 205 can be programmed to accept calibration input from a user and/or self-calibrate in relation to stored data about a particular flavoring fluid and/or sensor readings. For example, the controller 205 may be programmed to adjust the number of pulses per dose of a particular flavoring fluid, based on the viscosity of the particular flavoring fluid relative to the viscosity of water. Alternatively, the controller 205 could be programmed to adjust the number of pulses per dose of a particular flavoring fluid, based on the viscosity of the particular flavoring fluid relative to the viscosity of another standardized flavoring fluid and/or the relative change in viscosity between the two flavoring fluids over time.

The number of pulses per dose can be further adjusted to compensate for changes due to temperature, evaporation, or other measurable values that are linked with a perceived change in the flavor/taste of the fluid as a function of volume per pulse. One skilled in the art will appreciate that an adjustment of the number of pulses provided per dose can be standardized to a specific type of quantity related to a measurable physical characteristic, such as, but not limited to, temperature, carrier concentration, pure flavoring concentration, viscosity, density, color, etc. Furthermore, calibration steps with any combination of measurements can be carried out in any suitable order without departing from the scope of the embodiments.

FIG. 18 is a flow chart that illustrates an exemplary embodiment of a set of processing steps executed by controller 205 for a fluid dispensing system 200. Starting at 16-1, the fluid dispensing system 200 (FIG. 6) is turned on. That is, a power source (not shown) is coupled to the fluid dispensing system 200.

At 16-2, the controller 205 calibrates the number of pulses per dose (per size of beverage) or pulse characteristics (e.g. timing or amplitude) for each particular flavor provided by the fluid dispensing system 200. Calibration settings are stored in memory coupled to or integrated within the controller 205. Alternatively, calibration settings are entered by a user and/or derived from inputs provided by the user. After 16-2, the fluid dispensing system 200 waits for a user to input a request for a beverage of a particular size.

At 16-3, the controller 205 receives a request for a beverage of a particular size from the user. Such a request includes the size and flavor of the beverage requested. The size and flavor of the beverage requested is used to derive the dosage of the flavoring to be dispensed for the beverage, in terms of pulses per dose.

At 16-4, the controller 205 measures a parameter that affects the perceived taste of the flavoring liquid. As noted above, such parameters include, but are not limited to, temperature, carrier concentration, pure flavoring concentration, viscosity, density, color, etc.

At 16-5 the controller 205 determines whether or not the pulses per dose (per size of the beverage) or pulse characteristics (such as duration/amplitude) should be adjusted based on the measurement of the parameter in 16-4. If it is determined that the pulses per dose or pulse characteristics do not need to change (no path, 16-5), the controller 205 proceed to 16-7. On the other hand, if it is determined that the pulses per dose or pulse characteristics should be changed (yes path, step 16-5), the controller 205 proceeds to 16-6 in which the pulses per dose or pulse characteristics are changed for the particular drink request received at 16-3. The controller 205 then proceeds to 16-7.

At 16-7, the controller 205 signals the fluid dispensing system 200 to dispense an appropriate liquid flavoring based on the appropriate pulses per dose or pulse characteristics calculated.

FIG. 19 is a flow chart illustrating another exemplary embodiment of a process that can be executed by the controller 205 within fluid dispensing system 200. Starting at 17-1 a fluid dispensing system 200 (FIG. 6) is turned on. That is a power source (not shown) is coupled to the fluid dispensing system 200.

At 17-2, the controller 205 "primes" one or more pumps (e.g. discrete volume pump 204 shown in FIG. 6) included in the fluid dispensing system 200. The controller 205 also operates to "prime" other mechanical systems that are included in the fluid dispensing system 200.

At 17-3, the controller 205 calibrates the number of pulses per dose (per size of beverage) or pulse characteristics for each particular flavor provided by the fluid dispensing system 200. In some embodiments calibration settings are stored in memory coupled to or integrated within the controller 205. In other embodiments the calibration settings are entered by a user and/or derived from inputs provided by the user.

At 17-4, the controller 205 continues with a calibration procedure and measures/senses a parameter that affects the perceived taste of the flavoring liquid. As noted above, such parameters include, but are not limited to, temperature, carrier concentration, pure flavoring concentration, viscosity, density, color, etc.

At 17-5 the controller 205 determines whether or not the pulses per dose (per size of the beverage) or pulse characteristics should be adjusted based on the measurement of the parameter in 17-4. If it is determined that the pulses per dose or pulse characteristics do not need to change (no path, 17-5), the controller 205 proceeds to 17-7. On the other hand, if it is determined that the pulses per dose or pulse characteristics should be changed (yes path, 17-5), the controller 205 proceeds to 17-6 in which the pulses per dose or pulse characteristics are changed. The controller 205 then proceeds to 17-7.

At 17-7, the controller 205 instructs the different portions of the fluid dispensing system 200 to operate to dispense corresponding doses of any number of liquid flavorings based on requests by one or more users. That is, the fluid dispensing system 200 dispenses the appropriate liquid flavoring based on the appropriate pulses per dose or pulse characteristics calculated during the previous steps each time a beverage request is received during 17-7. In order to update the pulses per dose or pulse characteristics (since they may change over time), after a specified duration of time, the controller 205 loops back to 17-4 where the parameter that affects the perceived taste of the flavoring liquid is again measured and controller 205 repeats 17-5 to 17-7 as required.

Exemplary embodiments that have been described are merely illustrative of the application of the principles of the invention. Other arrangements, methods, subsets, or combinations of elements of the embodiments can be implemented by those skilled in the art without departing from the scope of the present invention.

We claim:

1. A liquid dispensing apparatus for beverages, the apparatus comprising:

a) a liquid reservoir for storing a liquid flavoring;

b) a diaphragm pump operable over discrete cycles, each discrete cycle comprising an intake stroke in which the liquid flavoring is drawn into the diaphragm pump from the liquid reservoir, and an expulsion stroke in which the liquid flavoring is expelled from the pump through a dispensing outlet, and wherein fully completing both the intake stroke and the expulsion stroke dispenses a predetermined volume of the liquid flavoring;

c) a DC power source for generating a series of electrical pulses for applying power to the diaphragm pump, each of the electrical pulses operating the diaphragm pump over at least one of the intake stroke and the expulsion stroke, each of the electrical pulses having pulse characteristics that affect an application of power to the diaphragm pump, the pulse characteristics comprising a pulse duration and a pulse frequency; and d) a controller for controlling the DC power source, the controller being operable to vary at least one of the pulse characteristics based upon characteristics of the diaphragm pump and the liquid flavoring such that the diaphragm pump dispenses the predetermined volume of liquid flavoring over each discrete cycle.

2. The apparatus of claim 1, wherein the controller varies the at least one of the pulse characteristics based upon the characteristics of the diaphragm pump and the liquid flavoring so that the diaphragm pump fully completes both the intake stroke and the expulsion stroke of each discrete cycle.

3. The apparatus of claim 1, wherein the characteristics of the diaphragm pump include a time required to fully complete at least one of the intake stroke or the expulsion stroke of the diaphragm pump.

4. The apparatus of claim 1, wherein the characteristics of the liquid flavoring include the viscosity of the liquid flavoring.

5. The apparatus of claim 1, wherein each of the electrical pulses comprises a high portion for operating the diaphragm pump over the intake stroke, wherein the duration of the high portion exceeds the time required for the diaphragm pump to fully complete the intake stroke.

6. The apparatus of claim 1, wherein each of the electrical pulses comprises a low portion for operating the diaphragm pump over the intake stroke, wherein the duration of the low portion exceeds the time required to fully complete the intake stroke.

7. The apparatus of claim 1, wherein each electrical pulse comprises a high portion corresponding to operating the diaphragm pump over the expulsion stroke, and wherein the duration of the high portion exceeds the time required to complete the expulsion stroke.

8. The apparatus of claim 1, wherein each electrical pulse comprises a low portion corresponding to operating the diaphragm pump over the expulsion stroke, and wherein the duration of the low portion exceeds the time required to fully complete the expulsion stroke.

9. The apparatus of claim 1, wherein the controller is operable to receive a user request for a particular beverage, and determine a number of the electrical pulses to be generated by the DC power source based upon at least the user request.

10. The apparatus for claim 9, wherein the controller further comprises a timing circuit operatively coupled to the DC power source, wherein the timing circuit generates a number of timing pulses corresponding to the number of electrical pulses; and wherein the DC power source comprises a switch operatively coupled to the timing circuit and the diaphragm pump, wherein the switch is configured to selectively couple and decouple the DC power source to the diaphragm pump in response to each of the number of timing pulses thereby activating the DC power source to generate each of the number of electrical pulses.

11. The apparatus of claim 10, wherein the number of timing pulses contain information to vary at least one of the pulse characteristics based upon the characteristics of the diaphragm pump and the liquid flavoring so that the diaphragm pump fully completes both the intake stroke and the expulsion stroke of each discrete cycle, and wherein the switch is configured to selectively couple and decouple the DC power source to the diaphragm pump so as to generate the number of electrical pulses having the at least one of the pulse characteristics.

12. The apparatus of claim 1, further comprising a power controller coupled to the DC power source to regulate the application of power to the diaphragm pump.

13. A method of dispensing liquid flavoring for beverages, the method comprising:

a) providing a diaphragm pump operable over discrete cycles, each discrete cycle comprising an intake stroke in which the liquid flavoring is drawn into the diaphragm pump from a liquid reservoir, and an expulsion stroke in which the liquid flavoring is expelled from the pump through a dispensing outlet, and wherein fully completing both the intake stroke and the expulsion stroke dispenses a predetermined volume of the liquid flavoring;

b) generating a series of electrical pulses for applying power to the diaphragm pump, each of the electrical pulses operating the diaphragm pump over at least one of the intake stroke or the expulsion stroke, each of the electrical pulses having pulse characteristics that affect an application of power to the diaphragm pump, the pulse characteristics comprising a pulse duration and a pulse frequency; and c) varying at least one of the pulse characteristics based upon characteristics of the diaphragm pump and the liquid flavoring such that the diaphragm pump dispenses the predetermined volume of liquid flavoring over each discrete cycle.

14. The method of claim 13, wherein varying the at least one of the pulse characteristics based upon the characteristics of the diaphragm pump and the liquid flavoring operates the diaphragm pump to fully complete both the intake stroke and the expulsion stroke of each discrete cycle.

15. The method of claim 13, wherein the characteristics of the diaphragm pump include a time required to fully complete at least one of the intake stroke or the expulsion stroke of the diaphragm pump.

16. The method of claim 13, wherein the characteristics of the liquid flavoring include the viscosity of the liquid flavoring.

17. The method of claim 13, wherein each of the electrical pulses comprises a high portion for operating the diaphragm pump over the intake stroke, and wherein varying at least one of the pulse characteristics comprises varying the pulse duration of the high portion to exceed the time required to fully complete the intake stroke.

18. The method of claim 13, wherein each of the electrical pulses comprises a low portion for operating the diaphragm pump over the intake stroke, and wherein the varying at least one of the pulse characteristics comprises varying the pulse duration of the low portion to exceed the time required to fully compete the intake stroke.

19. The method of claim 13, wherein each of the electrical pulses comprises a high portion for operating the diaphragm pump over the expulsion stroke, and wherein varying at least one of the pulse characteristics comprises varying the pulse duration of the high portion to exceed the time required to fully complete the expulsion stroke.

20. The method of claim 13, wherein each of the electrical pulses comprises a low portion for operating the diaphragm pump over the expulsion stroke, and wherein varying at least one of the pulse characteristics comprises varying the pulse duration of the low portion to exceed the time required to fully complete the expulsion stroke.

21. The method of claim 13, further comprising:

a) receiving a user request for a particular beverage; and b) determining a number of electrical pulses to be generated based upon at least the user request.

* * * * *